US010330410B2

(12) United States Patent
Miller et al.

(10) Patent No.: US 10,330,410 B2
(45) Date of Patent: Jun. 25, 2019

(54) AUTOMATIC/SEMI-AUTOMATIC RIFLE ASSEMBLY FOR LARGE CALIBER BELTED CARTRIDGES

(71) Applicant: Guardian Defense, LLC, Columbia Falls, MT (US)

(72) Inventors: Brandon W. Miller, Kalispell, MT (US); Dean G. Grommet, Whitefish, MT (US); Joshua R. Boyce, Kalispell, MT (US)

(73) Assignee: Guardian Defense LLC, Columbia Falls, MT (US)

( * ) Notice: Subject to any disclaimer, the term of this patent is extended or adjusted under 35 U.S.C. 154(b) by 1 day.

(21) Appl. No.: 14/479,218

(22) Filed: Sep. 5, 2014

(65) Prior Publication Data

US 2015/0267979 A1 Sep. 24, 2015

Related U.S. Application Data

(60) Provisional application No. 61/926,299, filed on Jan. 11, 2014, provisional application No. 61/879,311, filed on Sep. 18, 2013, provisional application No. 61/874,216, filed on Sep. 5, 2013.

(51) Int. Cl.

| | |
|---|---|
| ***F41A 9/34*** | (2006.01) |
| ***F41A 9/61*** | (2006.01) |
| ***F41A 3/36*** | (2006.01) |
| ***F41A 3/00*** | (2006.01) |
| ***F41A 9/29*** | (2006.01) |
| ***F41A 9/79*** | (2006.01) |

(Continued)

(52) U.S. Cl.

CPC *F41A 9/34* (2013.01); *F41A 3/00* (2013.01); *F41A 3/36* (2013.01); *F41A 9/29* (2013.01); *F41A 9/61* (2013.01); *F41A 9/79* (2013.01); *F41A 19/13* (2013.01); *F41A 5/18* (2013.01)

(58) Field of Classification Search

CPC ..... F41A 9/34; F41A 3/00; F41A 9/79; F41A 9/29; F41A 3/26; F41A 3/66; F41A 9/61; F41A 9/36; F41A 19/13; F41A 5/18

USPC ..... 102/430, 464–470; 89/125, 191.01

See application file for complete search history.

(56) References Cited

U.S. PATENT DOCUMENTS 1,399,440 A * 12/1921 Payne ..... F41A 9/34 89/33.16

1,674,370 A * 6/1928 Methlin ..... F41A 5/32 89/128

(Continued)

OTHER PUBLICATIONS

Patrick Sweeney, NEMO Omen .300 Win. Mag. Review, Aug. 19, 2013, Guns&Ammo, AR-15 Rifles, pp. 1-6; http://www.gunsandammo.com/reviews/nemo-omen-300-win-mag-review/.*

(Continued)

*Primary Examiner* — Joshua E Freeman

*Assistant Examiner* — Bridget A Cochran

(74) *Attorney, Agent, or Firm* — Christensen O'Connor Johnson Kindness PLLC

(57) ABSTRACT

Embodiments of the present disclosure provide modifications to the AR platform operating system such that the platform now is competent to fire large caliber cartridges, including belted cartridges, providing longer range and greater barrier penetration without substantially altering the characteristic features and component inter-relationships of this platform.

32 Claims, 15 Drawing Sheets

(51) Int. Cl.
*F41A 19/13* (2006.01)
*F41A 5/18* (2006.01)

(56) References Cited

U.S. PATENT DOCUMENTS 1,719,147 A * 7/1929 Tansley ..... F41A 9/34 89/33.01
2,359,263 A * 9/1944 Webb ..... F41A 9/32 193/34
2,951,424 A * 9/1960 Stoner ..... F41A 3/16 89/179
3,035,495 A * 5/1962 Stoner ..... F41A 9/32 89/33.01
3,198,076 A * 8/1965 Stoner ..... F41A 3/26 42/75.02
3,425,317 A * 2/1969 Menneking ..... F41A 3/66 89/33.2
3,453,929 A * 7/1969 Betzold ..... F41A 27/10 89/33.4
3,500,718 A * 3/1970 Stoner ..... F41A 3/04 89/1.4
3,566,744 A * 3/1971 Stoner ..... F41A 3/78 42/25
3,602,088 A * 8/1971 Spring ..... F41A 9/34 359/402
3,680,432 A * 8/1972 Rocha ..... F41A 9/37 89/14.5
3,732,643 A * 5/1973 Wells ..... F41A 9/69 42/50
3,744,371 A * 7/1973 McFarland ..... F41A 9/37 89/33.04
3,974,738 A * 8/1976 Meyer ..... F41A 9/34 89/34
4,015,511 A * 4/1977 Folsom ..... F41A 9/14 89/33.04
4,112,817 A * 9/1978 Bourlet ..... F41A 9/54 89/33.1
4,311,081 A * 1/1982 Gillum ..... F41A 9/37 89/33.04
4,579,034 A * 4/1986 Holloway ..... F41A 3/26 42/18
4,612,843 A * 9/1986 Marcon ..... F41A 9/37 89/33.04
4,942,802 A * 7/1990 Stoner ..... F41A 9/32 42/25
5,117,735 A * 6/1992 Flashkes ..... F41A 3/26 89/185
5,900,577 A * 5/1999 Robinson ..... F41A 11/02 89/156
6,152,012 A * 11/2000 Sherwood ..... F41A 9/34 89/33.14
6,293,040 B1 * 9/2001 Luth ..... F41A 11/02 42/75.01
6,634,274 B1 * 10/2003 Herring ..... F41A 5/26 89/191.01
6,681,677 B2 * 1/2004 Herring ..... F41A 5/26 89/191.01
7,444,775 B1 * 11/2008 Schuetz ..... F41A 9/71 42/49.02
7,568,421 B2 * 8/2009 Cummings ..... F41A 9/31 42/87
7,802,392 B2 * 9/2010 Peterson ..... F41A 11/02 42/124
7,886,470 B1 * 2/2011 Doiron ..... F41A 3/46 42/16
8,136,440 B1 * 3/2012 Shirts ..... F41A 9/29 89/33.14
8,234,808 B2 * 8/2012 Lewis ..... F41A 3/26 42/71.01
8,607,683 B1 * 12/2013 Burgermeister ..... F41A 9/31 89/33.16
8,985,007 B2 * 3/2015 Larson ..... F41A 3/66 89/140
2003/0213359 A1 * 11/2003 Kropf ..... F41H 5/14 89/36.09
2006/0207464 A1 * 9/2006 Maljkovic ..... C08L 65/02 102/466
2006/0283067 A1 * 12/2006 Herring ..... F41A 3/66 42/75.01
2009/0031606 A1 * 2/2009 Robinson ..... F41A 3/26 42/16
2010/0147277 A1 * 6/2010 Zimmerman ..... F41A 9/25 124/56
2010/0229445 A1 * 9/2010 Patel ..... F41A 3/66 42/6
2011/0048269 A1 * 3/2011 Schuster ..... F42B 5/025 102/470
2011/0107901 A1 * 5/2011 Lasichak ..... F41A 9/03 89/33.02
2012/0137869 A1 * 6/2012 Gomez ..... F41A 3/26 89/125
2012/0152094 A1 * 6/2012 Gonzalez ..... F41A 9/34 89/33.2
2012/0260793 A1 * 10/2012 Gomez ..... F41A 3/66 89/191.01
2013/0047828 A1 * 2/2013 Smith ..... F41A 9/01 89/33.14
2014/0076144 A1 * 3/2014 Gomez ..... F41A 3/38 89/132
2014/0260931 A1 * 9/2014 Iannello ..... F41A 9/79 89/33.14
2015/0135942 A1 5/2015 Gomez
2015/0267979 A1 * 9/2015 Miller ..... F41A 3/00 89/191.01
2016/0047611 A1 * 2/2016 Battaglia ..... F41A 3/14 42/16

OTHER PUBLICATIONS

Patrick Sweeney, NEMO Omen .300 Win. Mag. Review, Aug. 19, 2013, Guns&Ammo, AR-15 Rifles, pp. 1-6; http://www.gunsandammo.com/reviews/nemo-omen-300-win-mag-review/ (Year: 2013).*

Blah Blah, DIY Lightweight Bolt carrier: Anyone Done it?, Aug. 21, 2012, AR-15 Forums, pp. 1-7; https://www.ar15.com/forums/ar-15/DIY_Lightweight_Bolt_Carrier_Anyone_done_it_/4-582741/ (Year: 2012).*

D_, Lighten Bolt Carrier-Specs?, Nov. 17, 2010, Brian Eno's Forums . . . Maku mozo!, pp. 1-9; http://forums.brianenos.com/topic/117563-lighten-bolt-carrier-specs/ (Year: 2010).*

International Search Report dated Jun. 12, 2015, issued in corresponding International Application No. PCT/US2014/054411, filed Sep. 5, 2014, 3 pages.

Written Opinion of the International Searching Authority dated Jun. 12, 2015, issued in corresponding International Application No. PCT/US2014/054411, filed Sep. 5, 2014, 14 pages.

International Preliminary Report on Patentability and Written Opinion dated Mar. 17, 2016, issued in corresponding International Application No. PCT/US2014/054411, filed Sep. 5, 2014, 15 pages.

".300 Winchester Short Magnum DSSF Magazine," © 2017 AccurateMag, Monroe, Connecticut, Dec. 21, 2013, <http://store.accuratemag.com/308winchestershortmagnum box magazine.aspx> [retrieved Feb. 2, 2017], 1 page.

"Nemo OMEN 300 Win Mag Magazines, 14 Round," © 1997-2017 Impact Guns, Dec. 18, 2012, <http://www.impactguns.com/nemo-omen-300-win-mag-magazines-14-round-omn-ic107.aspx> retrieved Feb. 2, 2017], 2 pages.

* cited by examiner

AUTOMATIC/SEMI-AUTOMATIC RIFLE ASSEMBLY FOR LARGE CALIBER BELTED CARTRIDGES

CROSS-REFERENCES TO RELATED APPLICATIONS

This application claims the benefit of U.S. Provisional Application No. 61/874,216, filed Sep. 5, 2013, U.S. Provisional Application No. 61/879,311, filed Sep. 18, 2013, and U.S. Provisional Application No. 61/926,299, filed Jan. 11, 2014, the disclosures of which are hereby expressly incorporated in their entirety by reference herein.

BACKGROUND

The AR family of weapons and their derivatives include indirect gas operated versions, have been in use by the military and civilian population for many years. Firearms based on the AR family, including the AR-10, the AR-15 and the M16, are the primary weapon of choice for military units in the United States and abroad. It also is a rifle platform of choice among civilian sport marksmen and hunters.

Currently, this firearm platform is configured only for beltless cartridges. Examples of such cartridges include the 7.62×51 mm NATO cartridge, the 308 WIN cartridge, and other smaller caliber cartridges. This feature of the AR platform limits the choice of ammunition available for rifles in this family. In particular, it limits the shooting distance and barrier penetration possible with this platform. Currently, rifles in this family have a maximum range of about 800 meters, and a kinetic energy of less than about 2,400 ft lbs, exemplified by the 7.62×51 mm NATO cartridge. Rifles in this platform also tolerate a maximum operation pressure in the range of about 50,000 psi.

A belted cartridge is a cartridge having a shell casing with a pronounced "belt" around its base that continues 2-4 mm past the extractor groove and allows for proper headspacing in more powerful and larger cartridges. The addition of the belt to the casing prevents over-insertion into the chamber. Over-insertion can lead to catastrophic failure of the gun when fired with excessive headspace.

The use of larger and more powerful cartridges than those that can be used in the current AR platform are gaining popularity both in the military and in law enforcement, as well as among target shooters and big-game hunters. As one example, the 0.300 Winchester Magnum, a belted cartridge competent to travel over 1,800 meters with a kinetic energy in the range of about 3,800-4,000 ft lbs, is the most popular 0.30 caliber magnum with American hunters. It also is being adopted by law enforcement and certain branches of the military for long-range sniping and marksmanship. The desire for larger, more powerful (and belted) cartridges is at odds with the current AR platform.

There remains a need, therefore, for a modified AR platform competent to accept belted cartridges, particularly larger cartridges that safely, accurately and reliably extend the range and barrier penetration of the existing platform, while tolerating the enhanced pressures (in the range of at least about 65,000 psi) that these cartridges generate when firing. Particularly advantageous would be the ability to provide such a modified platform without substantially altering the characteristic features of the platform that have made it a weapon of choice

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, provided is a firearm from the AR family or platform having a gas operated firing system, either a direct gas operated firing system or an indirect gas operated derivative, modified to be competent to receive and safely, reliably and accurately fire a belted cartridge. As used herein, "AR platform" and "AR family" includes automatic and semi-automatic weapons, including the AR-10, the AR-15 and M-16 rifles. In one preferred embodiment, the belted cartridge enhances the range and barrier penetration of the AR platform. In another preferred embodiment, the modified AR platform described herein has a range of at least about 1,000-1,800 m. In another preferred embodiment, the modified AR platform described herein can fire ammunition with a kinetic energy of about 4,000 ft lbs, and has a barrier penetration capability in the range of at least about twice that of the 7.62×51 mm NATO cartridge. In still another preferred embodiment, the modified AR platform described herein accommodates pressures in the range of at least about 60,000 psi, more preferably at least about 65,000 psi when firing. In another preferred embodiment, the modified AR platform described herein accommodates pressures of at least in the range of about 80,000 psi.

In accordance with one embodiment of the present disclosure, provided is a firearm from the AR family having a gas operated firing system, either a direct gas operated firing system or an indirect gas operated derivative, modified to receive and safely, reliably and accurately fire a cartridge having a case length greater than 2.015 inches, an overall length greater than 2.800 inches, a base diameter greater than 0.4709 inches and a case capacity greater than 56 gr H20. In one preferred embodiment, the modified AR platform disclosed herein accommodates a cartridge having a case length in the range of about 2.62 inches, an overall length in the range of about 3.34 inches, a base diameter in the range of about 0.532 inches, and a case capacity in the range of about 90.4 gr H20. In another preferred embodiment, the modified AR platform disclosed herein accommodates a 0.300 Winchester cartridge. In still another preferred embodiment, the modified AR firearm disclosed herein accommodates a belted Winchester Magnum cartridge. In still another preferred embodiment, the belted Winchester Magnum cartridge is selected from the group consisting of the 264 Win Mag, 7 mm Win Mag, 300 Win Mag, 338 Win Mag, and the 458 Win Mag.

In accordance with still another embodiment of the present disclosure, provided is a firearm from the AR family having a gas operated firing system, either a direct gas operated firing system or an indirect gas operated derivative, modified to receive and safely, reliably and accurately fire a belted cartridge of greater length, mass and/or diameter than a 0.308 Winchester Magnum without substantially altering the inter-relational features and components of the AR platform. In one preferred embodiment, the modified AR platform disclosed herein maintains the integrity of the inter-relational fire assembly components of a standard or currently existing AR rifle. In another preferred embodiment, the trigger, hammer, safety, stock, grip, takedown pins, forearm, trigger group assembly, adjustable gas block, gas tube, pins, springs, buffer tube, buffer and spring, cam pin, carrier key, bolt stop latch, and mag release butt-stock assembly, as well as their operational or functional relationship with one another, remain unaffected.

In accordance with still another embodiment of the present disclosure, provided is a firearm from the AR family having a gas operated firing system, either direct or an indirect gas operated derivative, comprising an AR firearm assembly having an overall length in the range of about 10.700-10.800 inches, more preferably about 10.700-10.728 inches. In one preferred embodiment, the overall length of the modified firearm assembly is increased in the range of about 0.9-1.5 inches, more preferably in the range of about 0.95-1.3 inches, when compared with an AR-10 firearm assembly. As used herein, the term "firearm assembly" is understood to comprise: (a) upper and lower receivers; (b) bolt and bolt carrier and their associated components, including charging handle, firing pin and spring; (c) gas block and (d) barrel chamber.

In accordance with still another embodiment of the present disclosure, provided is a firing pin for use in a firearm from the AR family having a gas operated firing system, either a direct gas operated firing system or an indirect gas operated derivative, having an overall length in the range of about 4.8-5.2 inches, more preferably in the range of about 5.05-5.10 inches. In another embodiment, the firing pin of the present disclosure differs from a standard AR-10 firing pin by having an overall length that exceeds the overall length of an AR-10 firing pin about 1.5-1.85 inches, more preferably 1.7 to 1.8 inches. In another embodiment, the firing pin further comprises a spring defining a central channel and having an overall length in the range of about 0.490-0.510 inches, more preferably 0.493-0.497 inches; an overall diameter in the range of about 0.030-0.038 inches, more preferably 0.032-0.035 inches; and a spring wire diameter in the range of about 0.025-0.035 inches, more preferably 0.028-0.033 inches. In still another embodiment the central shaft of the firing pin disclosed herein comprises a standard gas flange, the shaft passes through the channel defined by the spring, and the gas flange diameter is dimensioned to act as a bracer or backstop for the spring. In still another embodiment, the spring is competent to inhibit firing pin inertia from accidentally discharging the firearm. In still another embodiment, the firing pin disclosed herein has a maximum mass of about 0.02-0.04 lbs, more preferably about 0.02-0.03 lbs. In one preferred embodiment, the firing pin comprises one or more lightening cuts at the distal, non-primer striking end of the pin, distal to the gas flange, so as to remove unneeded mass from the pin. Alternatively or, in addition, the mass of the pin is managed by the choice of base material. For example titanium or another light material may be chosen instead of steel. Those of ordinary skill in the art will appreciate that, if desired, a clearance relief also can be added to the striking tip of the firing pin.

In accordance with still another embodiment of the present disclosure, provided is an upper receiver for use in a firearm from the family having a gas operated firing system, either a direct gas operated firing system or an indirect gas operated derivative, comprising a mounting rail cut to Picatinny standards (e.g., MIL-STD-1913) and having an overall length in the range of about 8.60-9.65 inches, more preferably in the range of about 9.5-9.6 inches. In another embodiment, the mounting rail disclosed herein differs from a standard AR10 mounting rail by having an overall length increase in the range of about 0.9-1.5 inches, more preferably 0.95-1.3 inches. In still another preferred embodiment, the additional distance is added over the ejection port of the upper receiver. In still another embodiment of the present disclosure, the ejection port of the upper receiver has an overall length increase in the range of about 0.9-1.5 inches, more preferably 0.95-1.3 inches, when compared with the ejection port of a standard AR-10 upper receiver. In still another embodiment, the ejection port of the present disclosure has an overall longitudinal dimension in the range of about 3.4-4.5 inches, more preferably 4.0-4.45 inches.

In accordance with yet another embodiment of the present disclosure, provided is a charging handle for use in a firearm from the AR15/M16 family having a gas operated firing system, either a direct gas operated firing system or an indirect gas operated derivative, the charging handle having an overall length in the range of about 8.9-9.5 inches, more preferably in the range of about 8.95-9.3 inches. In another preferred embodiment, the charging handle disclosed herein differs in length from a standard AR-10 charging handle by having an overall length increase in the range of about 0.90-1.5 inches, more preferably 0.95-1.3 inches. In still another preferred embodiment, the charging handle disclosed herein has a tensile strength in the range of about 50,000 KSI of yield. In still another preferred embodiment, the charging handle disclosed herein has sufficient tensile strength to preclude or substantially inhibit bending of the charging handle during operation of the firearm. In one preferred embodiment, the desired tensile strength is achieved by use of a base material of greater tensile strength than 7075 aluminum. In another preferred embodiment, the base material comprises a material selected from the group consisting of titanium and steel. In still another preferred embodiment, the steel is a stainless steel.

In accordance with another embodiment of the present disclosure, provided is a bolt carrier for use in a firearm from the AR family having a gas operated firing system, either a direct gas operated firing system or an indirect gas operated derivative, the bolt carrier having an overall length in the range of about 8.900-9.000 inches, more preferably in the range of about 8.65-8.80 inches. In another preferred embodiment, the bolt carrier disclosed herein differs in length from a standard AR-10 bolt carrier by having an overall length increase in the range of about 0.90-1.5 inches, more preferably 0.95-1.3 inches. In another preferred embodiment the overall diameter of the bolt carrier is substantially the same as that for a standard AR-10 bolt carrier, having a diameter in the range of about 1.1875 inches. In still another embodiment, the bolt carrier hammer ramp length and angle are substantially the same as that for a standard AR-10 bolt carrier, and the hammer ramp position is modified such that it ends 4.855 inches from the posterior end of the bolt carrier and begins 4.125 inches from the anterior end of the bolt carrier. In still another preferred embodiment, the opening in the bolt carrier lower surface defining the hammer clearance is located about 2.660 inches from the posterior end of the carrier. In still another embodiment, the relative positions of the hammer ramp and hammer clearance to one another are the same as that for a standard AR-10 bolt carrier.

In still another embodiment, the bolt carrier comprises one or more relief cuts to reduce the overall mass of the carrier, thereby accommodating longer barrel lengths, lower gas pressures and varying cartridge loads, including lower cartridge loads. In a preferred embodiment, the relief cuts are made to the bolt carrier shaft, particularly to the upper and lower portions of the shaft. In still another embodiment, the upper relief cut begins in the range of about 3.25-4.50 inches, more preferably 4.30 inches, from the anterior or front end of the bolt carrier and extends for a distance in the range of about 3.250-4.400 inches, more preferably 4.300 inches. In another preferred embodiment the depth of the upper relief cut is in the range of about 0.200-0.300 inches, more preferably 0.250 inches. In still another preferred embodiment, the lower relief cut begins in the range of about 4.000-4.500 inches, more preferably 4.060 inches from the front or anterior end of the bolt carrier and extends for a distance of about 2.400-4.600 inches, more preferably 4.550 inches. In another preferred embodiment, the depth of the lower relief cut is in the range of about 0.150-0.300 inches, more preferably about 0.204 inches.

In accordance with another embodiment of the present disclosure, provided is a bolt for use in a firearm from the AR family having a gas operated firing system, either a direct gas operated firing system or an indirect gas operated derivative, the bolt having a bolt face diameter in the range of 0.530-0.540 inches, more preferably in the range of 0.533-0.537 inches. In another preferred embodiment, the bolt disclosed herein is competent to accommodate a cartridge of greater dimensions than standard cartridges for the AR family of rifles. In still another embodiment, the bolt disclosed herein is competent to accommodate a bolt larger in a dimension than a 7.62-51 mm NATO cartridge or a 5.56×45 mm NATO cartridge.

In accordance with another embodiment of the present disclosure, provided is a bolt extractor for use in a firearm from the AR family having a gas operated firing system, either a direct gas operated firing system or an indirect gas operated derivative, the bolt extractor having an extractor groove of a dimension in the range of about 0.260-0.281 radius inches, more preferably in the range of about 0.263-0.268 radius inches. In still another preferred embodiment, the radius of the bolt extractor groove is dimensioned to engage the rim of a belted cartridge. In still another preferred embodiment, the modified bolt extractor groove radius is competent to engage a belt of a 0.300 Winchester Magnum or larger caliber cartridge.

In accordance with another embodiment of the present disclosure, provided is a chamber for use in a firearm from the AR platform having a gas operated firing system, either a direct gas operated firing system or an indirect gas operated derivative, wherein the chamber wall thickness has a range of about 0.250-0.350 inches, more preferably 0.250-0.285 inches. In another preferred embodiment, the chamber comprises a chamfer at the posterior end of the chamber to facilitate feeding of a cartridge into the chamber. In still another embodiment, the chamber comprises a belt seat proximal to and anterior to the chamfer to act as a counter bore for the cartridge belt and thereby "seat" the cartridge, establishing proper head space. In one preferred embodiment, the chamfer has a length in the range of about 0.01-0.04 inches, more preferably in the range of 0.02-0.03 inches; and an angle in the range of about 20-60 degrees, more preferably 30-45 degrees. In another preferred embodiment, the chamber has a counter bore seat dimension (depth) in the range of about 0.0905-0.0965 inches.

In accordance with another embodiment of the present disclosure, provided is a lower receiver for use in a firearm from the AR platform having a gas operated firing system, either a direct gas operated firing system or an indirect gas operated derivative, the lower receiver having an overall length in the range of about 9.50-10.50 inches, more preferably in the range of about 10.070 inches. In another embodiment, the lower receiver disclosed herein differs from a standard AR10 lower receiver by having an overall length increase in the range of about 0.9-1.5 inches, more preferably 0.95-1.3 inches. In another preferred embodiment, the length increase in the lower receiver occurs in the longitudinal dimension of the magazine well. In still another preferred embodiment, the magazine well disclosed herein differs from the magazine well of a standard AR-10 lower receiver by having an overall length increase in the range of about 0.9-1.5 inches, more preferably 0.95-1.3 inches. In another preferred embodiment the magazine well of the present disclosure has a longitudinal dimension in the range of about 3.90-4.55 inches, preferably 3.95-4.45 inches. In another preferred embodiment, the magazine well of the present disclosure has a width in the range of about 0.30-1.10 inches; preferably 0.36-1.05 inches.

In accordance with another embodiment of the present disclosure, provided is a magazine for use in a firearm from the AR platform having a gas operated firing system, either a direct gas operated firing system or an indirect gas operated derivative, the magazine having a double stack capacity competent to receive belted cartridges and competent to fit and operate in the magazine well disclosed herein. In another embodiment, the double stack capacity magazine disclosed herein is competent to receive belted or non-belted cartridges ranging in length from about 2.800-3.625 inches. In still another embodiment, the magazine has external dimensions ranging in length from about 3.100-4.200 inches, more preferably 4.100 inches, a width ranging from about 1.000-1.500 inches, more preferably 1.125 inches, and a height ranging from about 2.0-8.0 inches, more preferably 5.150 inches. In still another embodiment, the magazine of the present disclosure has internal dimensions comprising a length in the range of about 2.800-4.100 inches, more preferably 3.800 inches, a width in the range of about 0.750-1.100 inches, more preferably 0.900 inches, and a height in the range of about 1.900-7.900 inches, more preferably 5.00 inches. In another embodiment, the magazine has an internal radius that aligns with the radius stacked cartridges. In one embodiment, the internal magazine radius is in the range of about 16-20 inches; in another embodiment, the radius is in the range of about 18.6 inches. Those skilled in the art will understand that preferred internal radii will be dictated by caliber choice and the radius produced by a stack of the selected caliber cartridges. In still another embodiment the magazine of the present disclosure is composed of a non-metal material of sufficient tensile strength to prevent magazine structural deformation during operation while having reduced friction during cartridge delivery as compared with a metal cartridge. In one preferred embodiment the magazine cartridge material comprises a glass-filled nylon comprising 30-50% glass composition.

In still another preferred embodiment, the overall length increase in the lower receiver occurs at least in part by means of an extension at the posterior end of the lower receiver. Preferably the length of this extension is in the range of about 0.45-0.75 inches, more preferably in the range of about 0.50-0.60 inches. In yet another preferred embodiment, the remainder of the overall length increase occurs at least in part in the linear length dimension of the magazine well in the lower receiver. Accordingly, another preferred embodiment is a lower receiver for use in a firearm from the AR platform comprising a magazine well having a posterior to anterior length in the range of about 4.500-4.600 inches, more preferably in the range of about 4.510 inches. In another preferred embodiment, the magazine well disclosed herein differs in length from a standard AR-10 magazine well by having an overall length increase in the range of about 0.20-1.05 inches. In one embodiment the increase constitutes a portion of the overall length increase of the lower receiver and is in the range of about 1.100 inches, more preferably 1.105 inches. In another embodiment, the increase constitutes the total increase in the overall length and the increase has a range of about 0.9-1.5 inches, more preferably 0.95-1.3 inches.

The AR platform utilizes either of two butt-stock assemblies: the rifle stock comprising a rifle length buffer and spring, and the carbine stock, comprising a carbine buffer and spring. Proper cycling of the bolt carrier into the receiver extension tube in the butt-stock is critical to reliable, safe functioning of the rifle action. In the modified AR firearm assembly disclosed herein there are two options for achieving this proper cycling with the larger caliber cartridges contemplated. Where the increase in the length of the lower receiver is achieved by increasing the magazine well by about 0.9-1.5 inches, proper cycling of the bolt carrier into the receiver extension tube can be achieved using a standard AR-10 rifle stock with a carbine buffer and spring. Alternatively, where the increase in the lower receiver length occurs by means of an extension at the posterior end of the lower receiver together with an increase in the magazine well length, proper cycling of the bolt carrier can be achieved using a carbine butt-stock with a carbine buffer and spring. Accordingly, in another embodiment of the present disclosure, provided is a firearm from the AR platform comprising a carbine buffer and buffer spring in a standard AR10 butt-stock.

The modifications disclosed herein individually and together define an AR platform that (1) mechanically accommodates a larger caliber cartridge than has been possible up until now, and (2) accommodates the greater pressures generated by a larger caliber cartridge when fired. In addition, the modified platform disclosed herein achieves these results without (1) substantially negatively impacting the safety, reliability or accuracy of the platform, or (2) substantially altering the inter-relational features of the platform's components. Examples of these components include, without limitation, the bolt stop, spring and plunger; magazine racks; hammer and trigger and their related pins and springs; and the safety, with its associated detents and springs. For these and other reasons, the disclosure presented herein provides a novel, unique and unanticipated or unobvious improvement over the rifles in the prior art.

In accordance with another embodiment of the present disclosure, provided is a firearm from the AR platform, namely a firearm with a gas operating system and a dual receiver assembly, comprising: an upper receiver assembly configured for receiving magazine-fed ammunition and having a mechanism for manually reciprocating the action of the firearm; a lower receiver assembly attached to the upper receiver assembly, the lower receiver assembly being configured to have an ammunition magazine attached thereto for supplying ammunition from the ammunition magazine to the upper receiver assembly; the upper receiver assembly being detachable from the lower receiver assembly; a buffer tube having a bore with a forwardly facing opening; and a bolt carrier assembly operative with the buffer tube during firearm operation. The firearm is competent to receive and fire a belted cartridge, and tolerates firing pressures in the range of at least about 65,000 psi. In another embodiment, the firearm tolerates firing pressures in excess of 80,000 psi.

In accordance with one embodiment of the present disclosure, a firearm assembly for use in the AR-15/M16 platform is provided. The firearm assembly has a gas operating system and a dual receiver assembly, the improvement wherein the firearm assembly is competent to receive, engage and fire a belted cartridge and comprises:

an upper receiver assembly configured for receiving magazine-fed ammunition and ejecting spent cartridge casings through an ejection port;

a detachable lower receiver assembly that engages the upper receiver assembly and being configured to have an ammunition magazine attached thereto for supplying ammunition from the ammunition magazine to the upper receiver assembly;

a buffer tube having a bore with a forwardly facing opening;

a bolt carrier assembly operative with the buffer tube during firearm operation;

a firing pin assembly comprising a firing pin and a firing pin spring and operative with the bolt carrier assembly during firearm operation;

a bolt assembly operative with the upper receiver assembly and the firing pin assembly during firearm operation and having a fluted anterior end, a channel for receiving the firing tip of the firing pin, and comprising a bolt extractor having a groove competent to engage the rim of a belted cartridge;

a charging handle that engages the upper receiver assembly;

a barrel chamber operative with the upper receiver assembly during firearm operation and comprising a counter bore at its posterior end competent to receive and seat a belted cartridge; and a double stack capacity magazine composed of a non-metal material, competent to fit into a magazine well in said lower receiver assembly and having an inner radius in the range of 16 to 20 inches.

In accordance with another embodiment of the present disclosure, a firearm assembly for use in the AR-15/M16 platform is provided, having a gas operating system and a dual receiver assembly, the improvement wherein the firearm assembly is competent to receive, engage and fire a belted cartridge.

In accordance with another embodiment of the present disclosure, a method of firing a belted cartridge having a range of at least 1,000 meters from an AR-15/M16 platform firearm is provided. The method includes:

providing an AR-15/M16 platform firearm assembly comprising an upper receiver, a lower receiver, a bolt and bolt carrier, a charging handle, a firing pin and spring, a gas block and a barrel chamber, said firing pin having an overall length in the range of about 4.8 inches to 5.2 inches and a mass of less than about 0.04 pounds;

providing magazine comprising the belted cartridge to the magazine well of the lower receiver of the AR-5/M16 firearm, the magazine well adapted to receive the magazine and having an overall length in the range of 3.90 inches to 4.55 inches and a width in the range of 0.30 inches to 1.35 inches; and initiating firing of the firearm.

In accordance with another embodiment of the present disclosure, an automatic or semi-automatic firearm assembly configured for firing a belted cartridge is provided. The firearm assembly comprising:

a firing pin;

a bolt assembly operative with the firing pin including a bolt and a bolt extractor; and a barrel chamber having anterior and posterior ends for receiving the belted cartridge, wherein the barrel chamber includes a counter bore at its posterior end to interface with the belted portion of the belted cartridge.

In accordance with another embodiment of the present disclosure, a magazine for a firearm assembly automatic or semi-automatic firearm assembly is provided. The magazine comprising:

a magazine body defining an inner chamber having length, width, and height dimensions, the inner chamber configured for receiving one more belted cartridges, the inner chamber having an internal radius in the range of about 16 inches to about 20 inches; and a follower assembly configured for following stacked belted cartridges in the magazine body.

A firearm assembly in accordance with any of the embodiments described herein may be competent to tolerate pressures in the range of at least 60,000 psi during operation.

A firearm assembly in accordance with any of the embodiments described herein may be competent to tolerate pressures in the range of at least 64,000 psi during operation.

A firearm assembly in accordance with any of the embodiments described herein may have an overall increased length in the range of about 0.90-1.5 inches when compared to the overall length of an AR-10 assembly.

A firearm assembly in accordance with any of the embodiments described herein may have the increased length is in the range of about 0.95-1.3 inches.

A firearm assembly in accordance with any of the embodiments described herein may have s bolt extractor groove having a radius in the range of about 0.260-0.270 inches.

A firearm assembly in accordance with any of the embodiments described herein may have a bolt in the bolt assembly having a bolt face at its fluted end with a diameter in the range of 0.530-0.540 inches.

A firearm assembly in accordance with any of the embodiments described herein may have the firing pin shaft has an overall increased length in the range of about 1.5 inches to 1.85 inches when compared with the shaft of an AR-10 firing pin.

A firearm assembly in accordance with any of the embodiments described herein may have a charging handle shaft having an overall increased length in the range of 1.5 inches to 1.85 inches when compared with the shaft of an AR-10 charging handle.

A firearm assembly in accordance with any of the embodiments described herein may have a counter bore chamber depth in the range of 0.0905 and 0.0965 inches, and a diameter in the range of 0.530 inches and 0.535 inches.

A firearm assembly in accordance with any of the embodiments described herein may have a carbine buffer tube.

A firearm assembly in accordance with any of the embodiments described herein may have a magazine including a body having a width in the range of about 1.00 inches to 1.50 inches, a height in the range of 2.0 inches to 8.0 inches and an internal radius in the range of 16 inches to 20 inches.

A firearm assembly in accordance with any of the embodiments described herein may have a bolt carrier having an overall increased length in the range of 0.9 inches to 1.5 inches when compared with an AR-10 bolt carrier.

A firearm assembly in accordance with any of the embodiments described herein may include a belted cartridge that is a Winchester Magnum cartridge.

A firearm assembly in accordance with any of the embodiments described herein may have a belted cartridge selected from the group consisting of: 264 Win Mag, 7 mm Win Mag, 300 Win Mag, 338 Win Mag, and 458 Win Mag.

A firearm assembly in accordance with any of the embodiments described herein may have a belted cartridge selected from the group consisting of: 240 Weatherby, 7 mm Remington Mag, 7 mm Ultra Mag, 300 Ultra Mag, 338 Edge, 338 Lapua, 458 Lott, 375 H&H, and 300 H&H.

A firearm assembly in accordance with any of the embodiments described herein may have a bolt assembly disposed within a bolt carrier for automatic action cycling.

A firearm assembly in accordance with any of the embodiments described herein may have a bolt carrier including relief cuts for reduced mass.

A firearm assembly in accordance with any of the embodiments described herein may have a bolt carrier return system for returning the carrier to a biased position.

A firearm assembly in accordance with any of the embodiments described herein may have a bolt carrier return system include a biasing device.

A firearm assembly in accordance with any of the embodiments described herein may have a bolt carrier return system further including a travel limiting device.

A firearm assembly in accordance with any of the embodiments described herein may have a direct impingement gas system for automatic action cycling.

A firearm assembly in accordance with any of the embodiments described herein may have a gas system sized and configured for a belted cartridge.

A firearm assembly in accordance with any of the embodiments described herein may be configured to tolerate pressures in the range of at least 60,000 psi during operation.

A firearm assembly in accordance with any of the embodiments described herein may be configured to tolerate pressures in the range of at least 64,000 psi during operation.

A firearm assembly in accordance with any of the embodiments described herein may have an overall increased length in the range of about 0.90 inches to 1.5 inches when compared to the overall length of an AR-10 assembly.

A firearm assembly in accordance with any of the embodiments described herein may have a bolt extractor including a groove having a radius in the range of about 0.260 inches to 0.270 inches.

A firearm assembly in accordance with any of the embodiments described herein may have a bolt having a bolt face having a diameter in the range of 0.530 inches to 0.540 inches.

A firearm assembly in accordance with any of the embodiments described herein may have a firing pin shaft having an overall increased length in the range of about 1.5 inches to 1.85 inches when compared with the shaft of an AR-10 firing pin.

A firearm assembly in accordance with any of the embodiments described herein may have a counter bore chamber depth in the range of 0.0905 inches to 0.0965 inches A firearm assembly in accordance with any of the embodiments described herein may have a counter bore diameter in the range of 0.530 inches to 0.535 inches.

A firearm assembly in accordance with any of the embodiments described herein may have a bolt carrier having an overall increased length in the range of 0.9 inches to 1.5 inches when compared with an AR-10 bolt carrier.

A firearm assembly in accordance with any of the embodiments described herein may have a magazine having a magazine body defining an inner chamber for receiving stacked belted cartridges, the inner chamber having an internal radius in the range of about 16 inches to about 20 inches.

A firearm assembly in accordance with any of the embodiments described herein may have a length of the inner chamber in the range of about 2.4 inches to about 4.1 inches.

A firearm assembly in accordance with any of the embodiments described herein may have a width of the inner chamber in the range of about 0.75 inches to about 1.1 inches.

A firearm assembly in accordance with any of the embodiments described herein may have a height of the inner chamber in the range of about 1.9 inches to about 7.9 inches.

A magazine in accordance with any of the embodiments described herein having a double stack capacity.

A magazine in accordance with any of the embodiments described herein may be made from a non-metal material.

A magazine in accordance with any of the embodiments described herein may have a length of the inner chamber in the range of about 2.4 inches to about 4.1 inches.

A magazine in accordance with any of the embodiments described herein may have a width of the inner chamber in the range of about 0.75 inches to about 1.1 inches.

A magazine in accordance with any of the embodiments described herein may have a height of the inner chamber in the range of about 1.9 inches to about 7.9 inches.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Embodiments of the present disclosure provide a modified firearm assembly for the AR platform, having a gas operated firing system, either a direct impingement gas operated firing system or an indirect gas operated derivative, and components thereof such that the platform now is configured to receive and reliably, safely and accurately fire large caliber cartridges, including belted cartridges, particularly belted cartridges that exceed the bullet range and kinetic energy of the 0.308 WIN cartridge.

Figure 1:
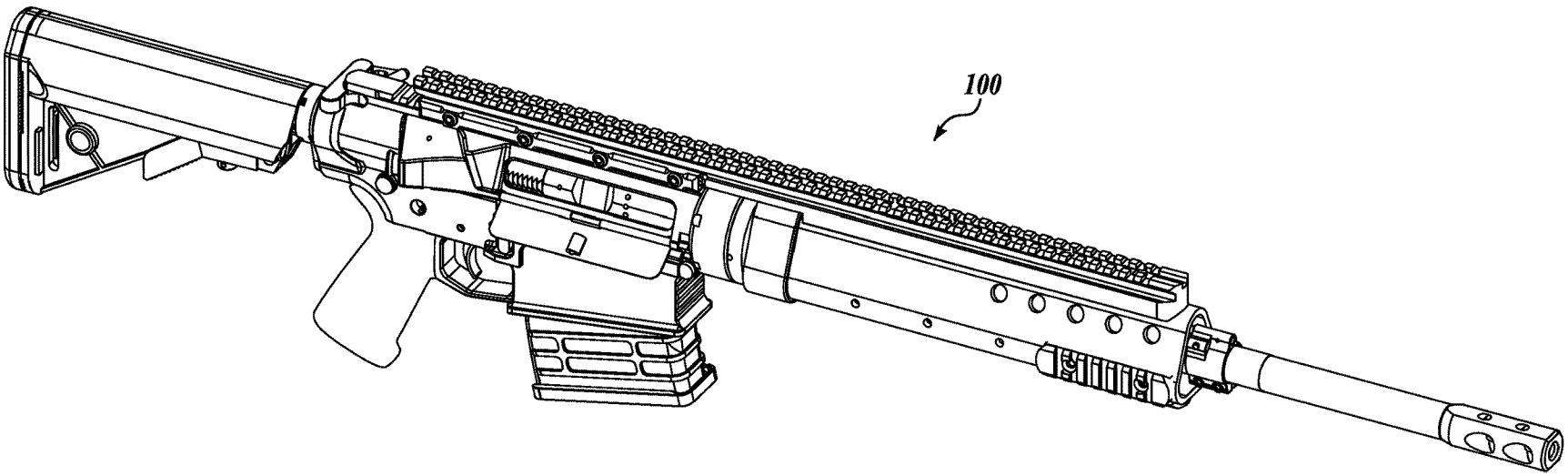
FIG. 1 is a perspective view of a firearm in accordance with one embodiment of the present disclosure.

Referring to FIG. 1, firearm 100 of the present disclosure is illustrated. A key feature of the firearms of the present disclosure is that the firearms can accommodate larger caliber cartridges, particularly belted cartridges, without substantially altering the characteristic features of the firearm assembly of an AR platform rifle. As a non-limiting example, a belted cartridge can be a 0.300 Winchester Magnum cartridge.

Figure 2:
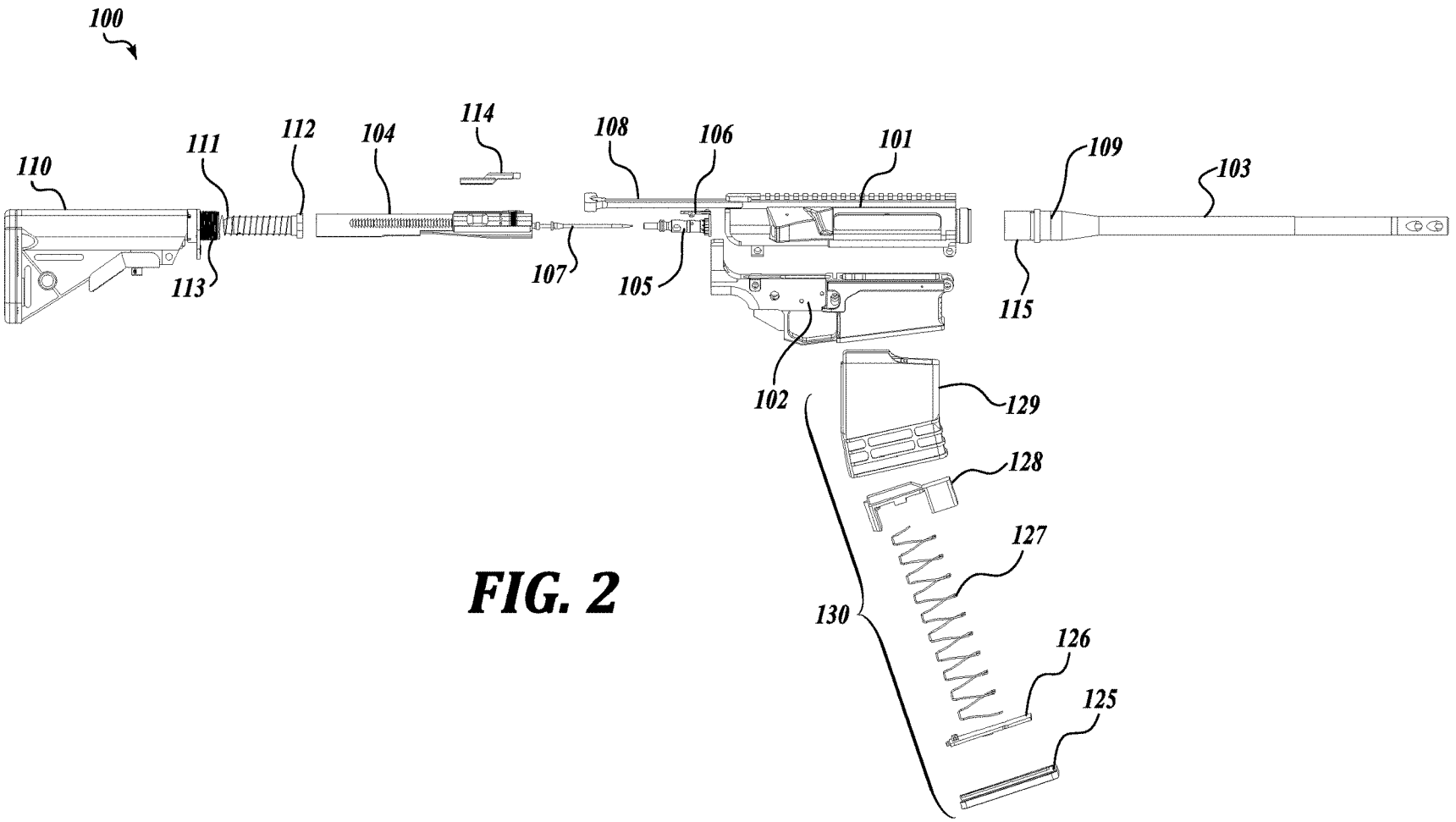
FIG. 2 is an exploded side view of the firearm of FIG. 1.

One characteristic feature of this platform is the ability to interchange standard "off the shelf" components of the firearm assembly. Representative components commonly interchanged include, without limitation, the stock, grip, takedown pins, forearm, trigger group assembly, adjustable gas block, gas tube, safety, pins, springs, buffer tube, buffer and spring, cam pin, carrier key, bolt stop latch, and mag release butt-stock assembly. The modified firearm of the present disclosure does not interfere with or alter the ability to interchange these components. The firearm of the present disclosure has been modified to maintain the inter-relationship of these interchangeable components by making modifications to other aspects of the firearm assembly. Referring now to FIG. 2, an exploded view of a firearm of the present disclosure is provided, illustrating the interrelationship and proper assembly of the components of the firearm. A number of the interchangeable components are identified, including the butt-stock 110, buffer tube 113, buffer spring 111, buffer 112, carrier key 114, barrel extension 115, and the barrel 103.

Figure 9B:
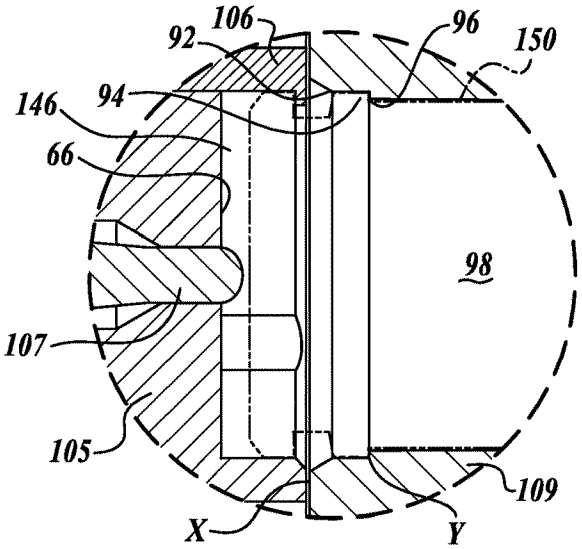
FIG. 9B is a detail view of a portion of the barrel assembly of FIG. 9A.
Figure 9A:
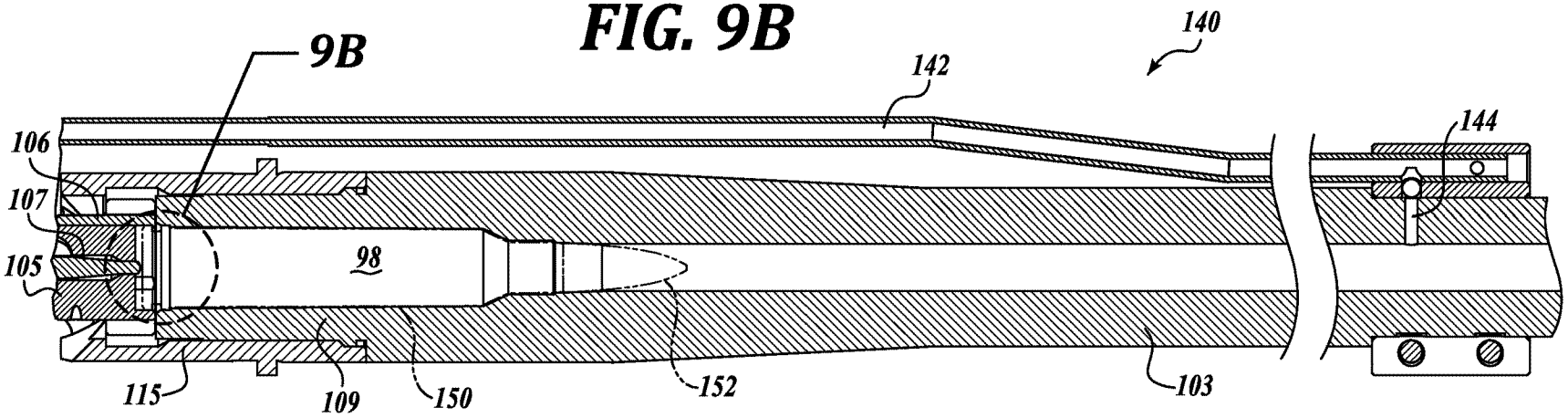
FIG. 9A is a cross-sectional side view of the barrel assembly of the firearm of FIG. 1.

Also identified in FIG. 2 are components that may have been modified to accommodate a belted cartridge, particularly a belted cartridge 150 of a larger caliber than 0.308 inches (see FIG. 9A). These modified components may include, without limitation, one or more of the upper receiver 101, the lower receiver 102, the magazine assembly 130, the barrel chamber 109, the bolt carrier 104, the bolt 105, the bolt extractor 106, the firing pin 107 and the charging handle 108. The modifications disclosed herein to these components together both mechanically accommodate the larger caliber cartridges envisioned for use in the firearms of the present disclosure, and accommodate the higher pressures these larger caliber cartridges generate when fired. As disclosed hereinbelow, the modifications to particular components are described. Those of ordinary skill in the art of firearm manufacture will appreciate the preferred base materials and dimensional tolerances to be chosen for these modifications, in light of the present disclosure.

Figure 3A:
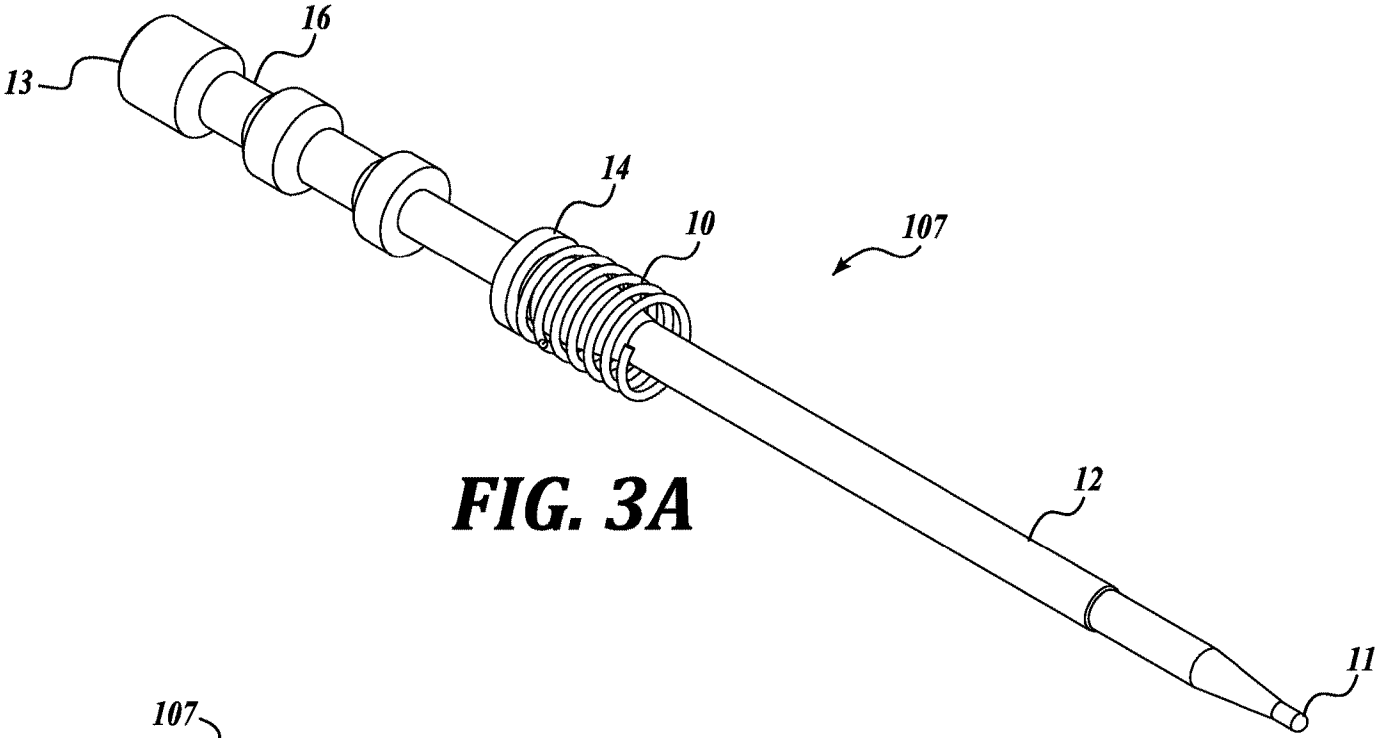
FIG. 3A is an isometric view of the firing pin of the firearm of FIG. 1.
Figure 3B:
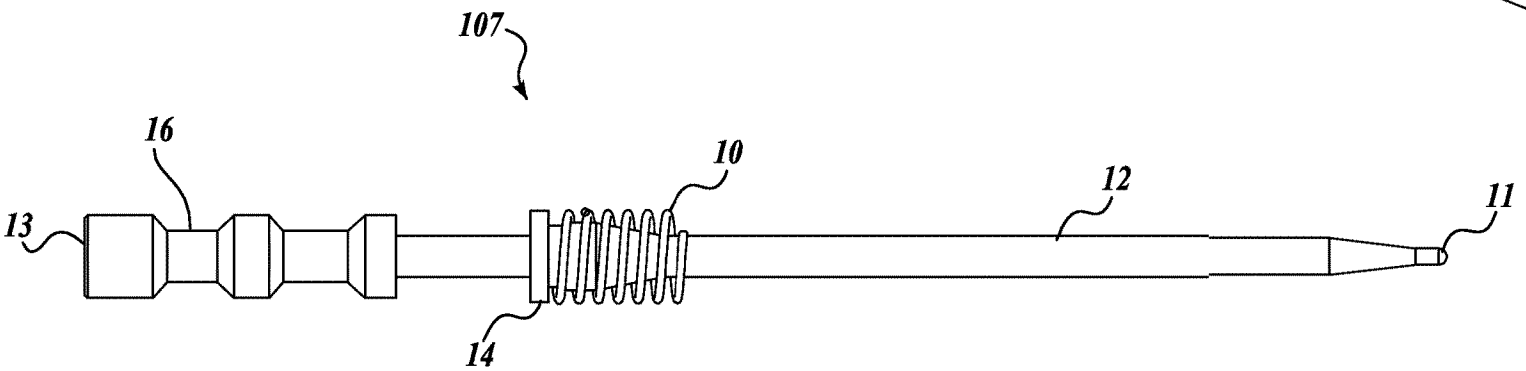
FIG. 3B is a side view of the firing pin of the firearm of FIG. 1.

Referring now to FIGS. 3A-3B, the firing pin 107 of the present disclosure and useful in the firearm assemblies of the present disclosure, comprises a shaft 12, a firing tip end 11 at the anterior end of the pin, a gas flange 14. The firing tip end 11 of firing pin 107 is configured to impact the primer of belted cartridge 150 such that the impact-sensitive chemical mixture within the primer produces heat to ignite the charge of the cartridge. The firing pin 107 differs from the standard firing pins of the AR platform, particularly firing pins of utility in the AR-10 firearm assembly, in that the length of shaft 12 is increased by about 1.5-1.85 inches, more preferably 1.70-1.78 inches, as compared with an AR-10 firing pin. The length of shaft 12 is increased to accommodate dimensional changes to the magazine assembly 130 as described in detail below. In another embodiment, the overall length of firing pin 107 is in the range of about 4.8-5.2 inches, more preferably 5.05 to 5.10 inches.

The diameter of shaft 12, overall diameter of firing pin 107, and diameter of gas flange 14 need not be substantially altered from that of a standard AR-10 firing pin. In addition, the firing pin 107 comprises a spring 10 defining a channel through which the firing pin shaft 12 can pass. Inclusion of the spring 10 keeps the inertia of firing pin 107 from accidentally discharging the firearm if the firearm is dropped or otherwise impacted. The spring 10 has a maximum diameter such that the gas flange 14 acts as a backstop. The spring 10 has an overall length in the range of about 0.490-0.51 inches, an overall diameter in the range of about 0.030-0.038 inches, and a spring wire diameter in the range of about 0.030-0.038 inches. Those of ordinary skill in the art can determine the desired base material and force characteristics for a spring 10.

Due to the increased length of shaft 12, the firing pin 107 has a larger mass than a standard firing pin for an AR platform rifle. Typically such pins have a mass in the range of about 0.02 pounds when made of steel. A firing pin 107 of the present disclosure made of steel would have a mass of about 0.04 pounds. Those of ordinary skill in the art will appreciate that the overall mass of firing pin 107 can be reduced by introducing one or more lightening cuts 16 to the posterior end 13 of the pin, and/or by using a lighter base material that provides appropriate strength, such as titanium. It is important to reduce the mass of firing pin 107 sufficiently to avoid overriding the spring 10 and causing accidental discharge of the firearm. A preferred maximum mass for firing pin 107 is in the range of about 0.02-0.04 pounds, more preferably in the range of 0.020-0.030 pounds. In addition, those of ordinary skill in the art appreciate that an optional clearance relief (not shown) can be added to the firing tip 11 of the firing pin 107.

Referring to FIGS. 4A-4D, an upper receiver 101 is provided and configured to interface barrel 103 and barrel extension 115 and receive bolt carrier 104. Upper receiver 101 comprises an integral mounting rail 20, preferably cut to Picatinny standards (e.g., ML-STD-1913) to provide a standard mounting platform for various accessories and attachments, such as an optical sighting scope, and an ejection port 22, through which spent cartridge casings (not shown) are released. Upper receiver 101 also includes upper receiver mating system 24 for mating to a lower receiver 102 (see FIG. 2), described in greater detail below. The mounting rail 20, and therefore the upper receiver 101, differs from a standard upper receiver of the AR platform, particularly an upper receiver for use in an AR-10 firearm assembly, by having an increased overall length of about 0.9-1.5 inches, more preferably 0.95-1.3 inches. In a preferred embodiment, the additional length is provided by extending the longitudinal dimension or length of the ejection port 22 and overlying mounting rail 20 by about 0.9-1.5 inches, more preferably 0.95-1.3 inches. The increased length of the ejection port allows clearing of the larger shells of the cartridges envisioned for use in firearm 100 of the present disclosure. The increased length of the overall upper receiver 101 accommodates the longer firing pin 107 and the dimensional changes to the magazine assembly 130 as described in detail below. Accordingly, in a preferred embodiment, the upper receiver comprises a mounting rail cut to Picatinny standards and having an overall longitudinal dimension in the range of about 8.6-9.6 inches, more preferably about 9.5-9.6 inches. In another preferred embodiment, the upper receiver of this disclosure comprises an ejection port having a longitudinal dimension in the range of about 3.4-4.5 inches, preferably 4.0-4.45 inches.

Figure 5A:
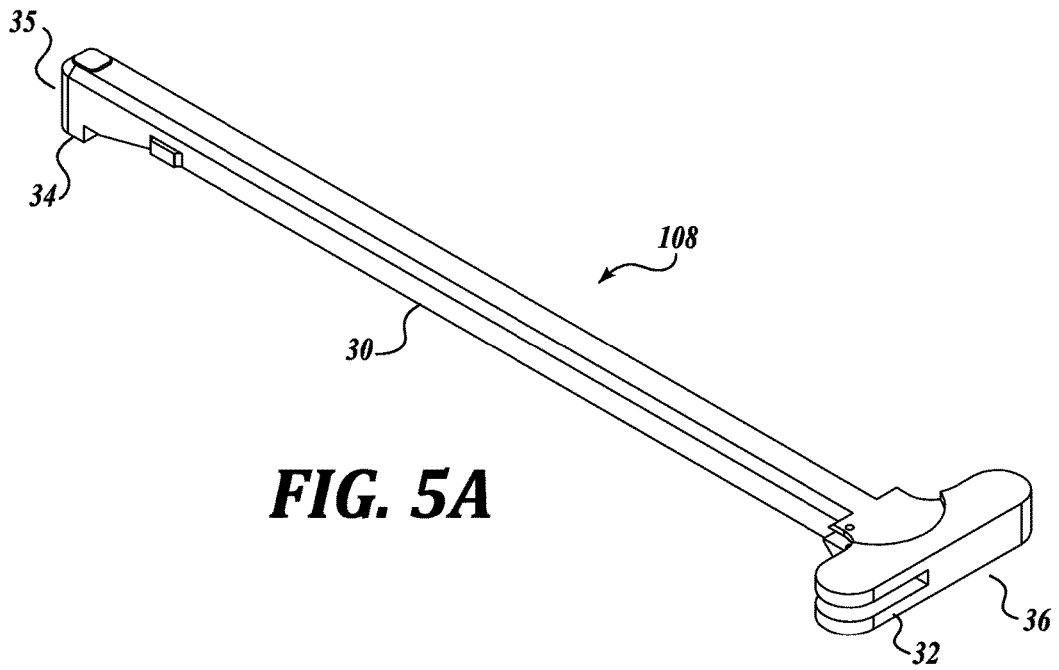
FIG. 5A is an isometric view of the charging handle of the firearm of FIG. 1.
Figure 5B:
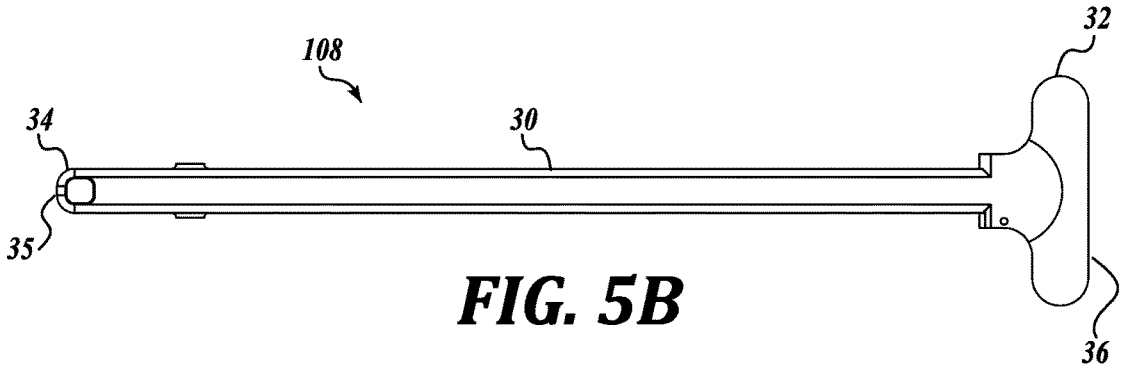
FIG. 5B is a top view of the charging handle of the firearm of FIG. 1.
Figure 5C:
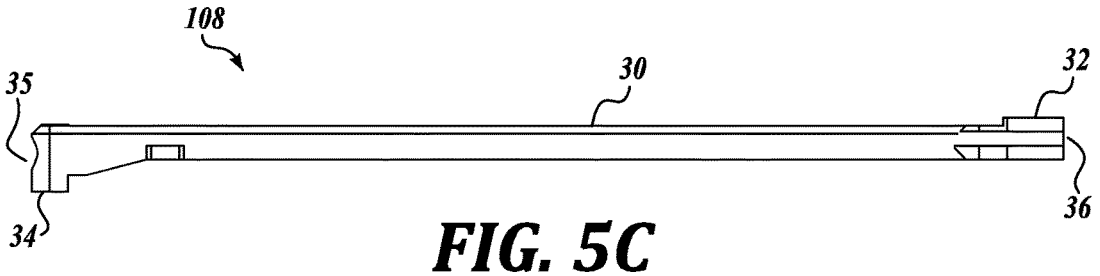
FIG. 5C is a side view of the charging handle of the firearm of FIG. 1.

Referring to FIGS. 5A-5C, a charging handle 108 is provided. Charging handle 108 is in contact with bolt carrier 104 and configured to manually load the initial belted cartridge 150 from the magazine assembly 130 to barrel chamber 109 (see FIG. 2). Thereafter, discharge of the rifle allows the automatic action cycling system to automatically load subsequent cartridges 150 without the use of the charging handle 108. Like standard charging handles used in AR-10 firearm assemblies, charging handle 108 comprises a shaft 30, an engagement end 34 at anterior end 35 of the charging handle 108, and a finger grip 32 at the posterior end 36.

Charging handle 108 differs from a standard charging handle of the AR platform in that the shaft 30 has a greater length in the range of about 0.9-1.5 inches, more preferably 0.95-1.3 inches when compared with an AR-10 charging handle. In another embodiment, the overall length of the charging handle is in the range of about 8.9-9.5 inches, more preferably in the range of 8.95-9.3 inches. Both the finger grip 32 and the engagement end 34 can remain as they exist for the current AR platform, that is to say, they are substantially unchanged in charging handle 108 disclosed herein. In a preferred embodiment the charging handle, and more particularly at least the shaft 30, is composed of a base material having greater rigidity and strength than the base material 7075 aluminum used in standard charging handles of the AR platform. In one preferred embodiment the preferred base material of the shaft 30 comprises titanium. In another preferred embodiment, the shaft base material comprises steel, particularly stainless steel.

Figure 6A:
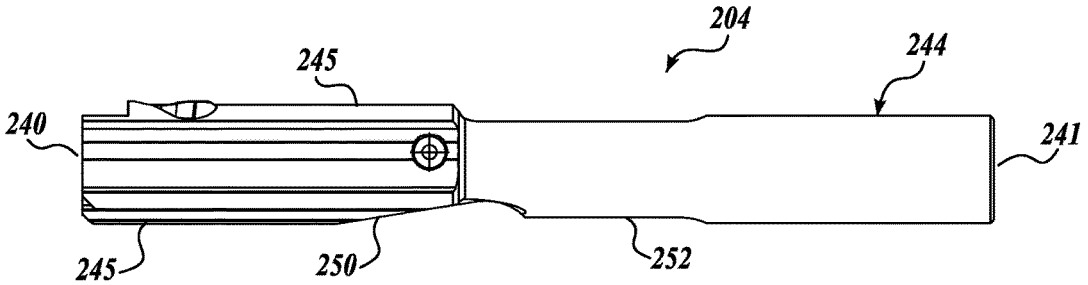
FIG. 6A (PRIOR ART)
FIG. 6A is a side view of a prior art bolt carrier.
Figure 6B:
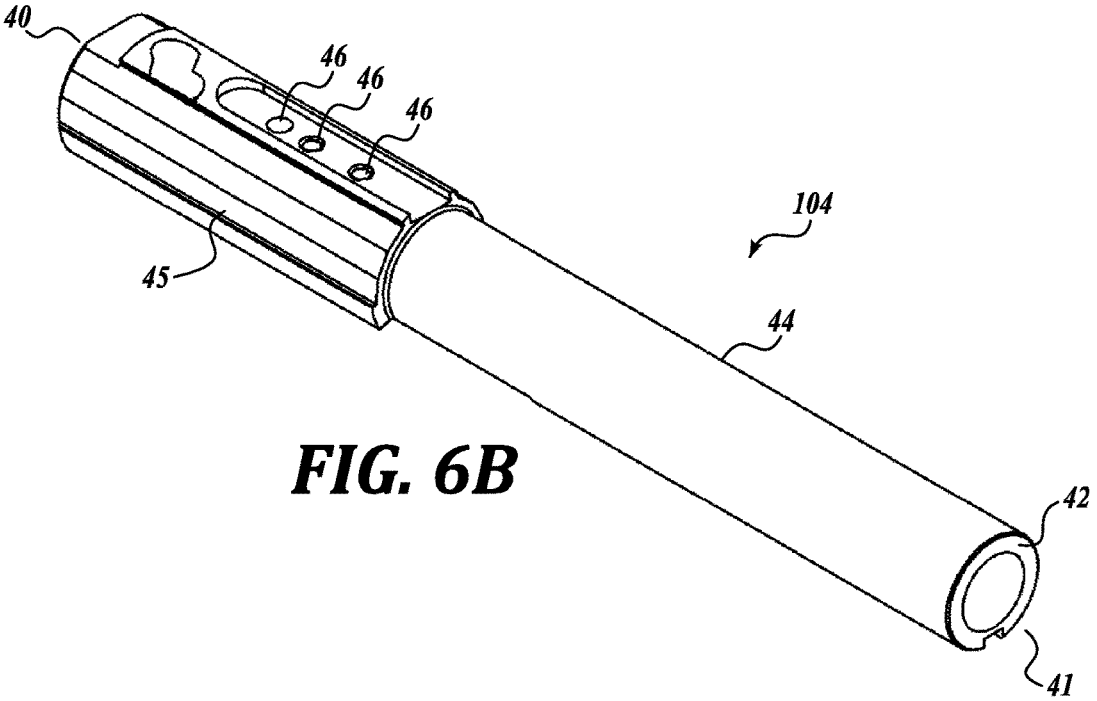
FIG. 6B is an isometric view of a bolt carrier of the firearm of FIG. 1 formed in accordance with a first embodiment of the present disclosure.
Figure 6C:
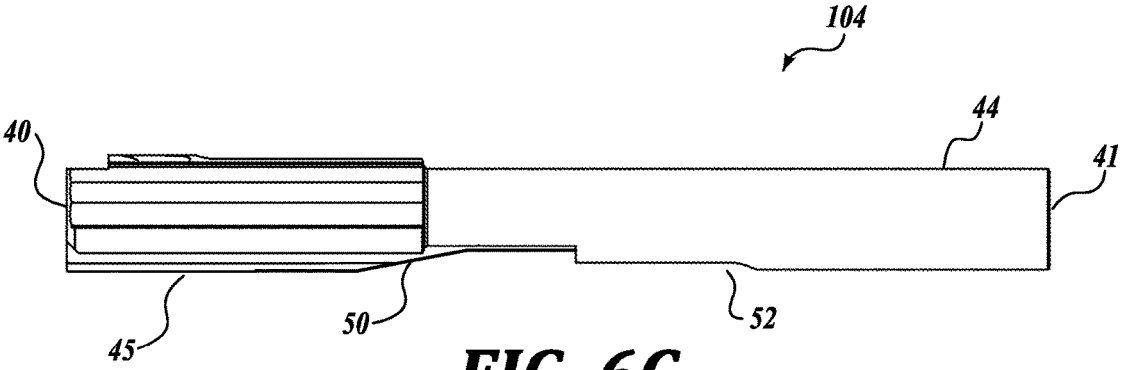
FIG. 6C is a side view of a bolt carrier of the firearm of FIG. 1 formed in accordance with a first embodiment of the present disclosure.
Figure 6D:
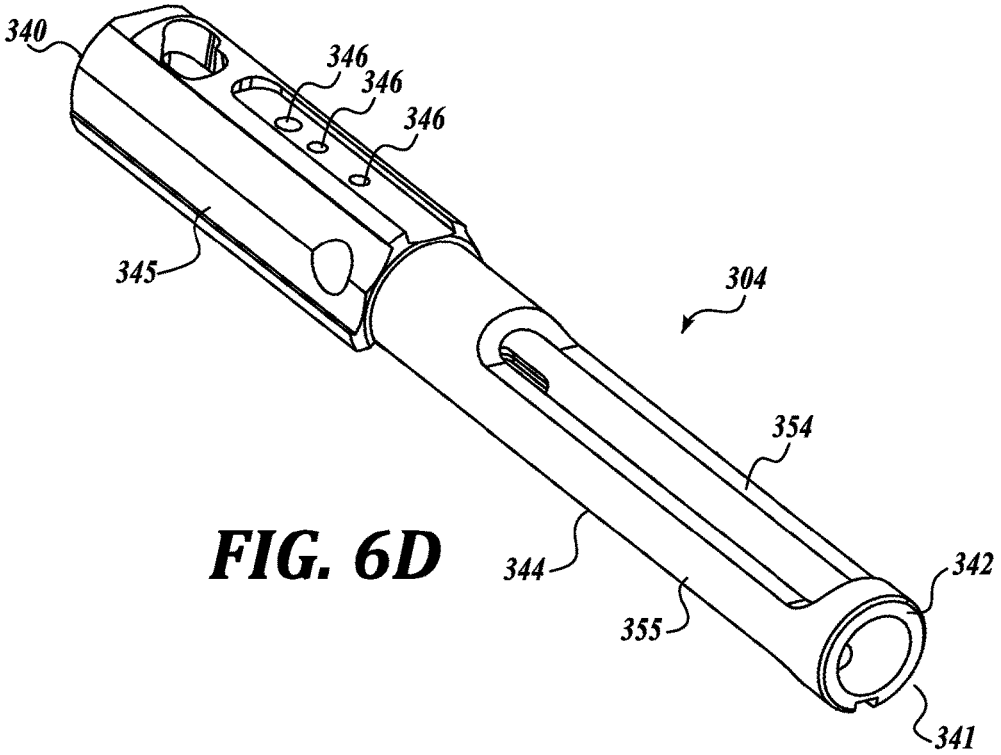
FIG. 6D is an isometric view of a bolt carrier of the firearm of FIG. 1 formed in accordance with a second embodiment of the present disclosure.
Figure 6E:
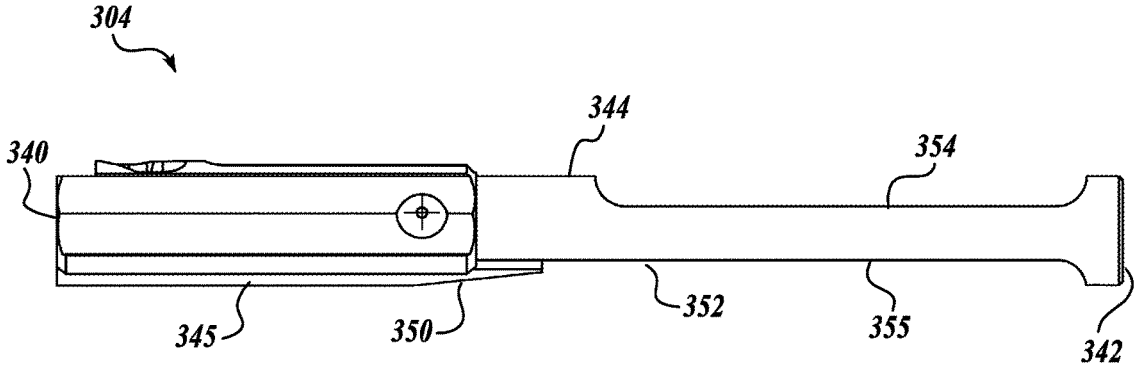
FIG. 6E is a cross-sectional side view of a bolt carrier of the firearm of FIG. 1 formed in accordance with a second embodiment of the present disclosure.

Referring now to FIGS. 6A-6E various bolt carriers are described in accordance with embodiments of the present disclosure. Bolt carrier 104 is configured to move within upper receiver 101 and is operatively associated with bolt 105, described in greater detail below. FIG. 6A illustrates a previously designed bolt carrier 204 used in standard AR-10 firearm assemblies. For clarity, features of the previously designed bolt carrier 216 are denoted in the 200 series. FIGS. 6B-6E illustrate two embodiments of bolt carrier 104 of the present disclosure. In particular, FIG. 6B and FIG. 6C provide two views of one embodiment of bolt carrier 104, and FIG. 6D and FIG. 6E provide two views of another embodiment of bolt carrier 304, denoted in the 300 series for clairty.

Now referring to FIGS. 6B and 6C, bolt carrier 104 comprises a shaft 44, a buffer end 42 at posterior end 41 of the bolt carrier 104, a bolt surface 45 at the anterior end 40 of the bolt carrier 104, and one or more gas ports 46. Bolt carrier 104 is operatively associated with bolt 105 at anterior end 40. In a preferred embodiment, the bolt carrier 104 comprises at least three gas ports 46. In addition, both bolt carrier 104 and previously designed bolt carrier 204 comprise hammer ramps 50 and 250. Hammer ramp 50 is configured to interface the firing controls and return the controls to firing position.

The bolt carrier 104 of the present disclosure differs from a standard AR platform bolt carrier 204 in that the overall length of shaft 44 is increased in the range of about 0.9-1.5 inches, more preferably 0.95-1.3 inches. In a preferred embodiment the increased length is achieved by moving the hammer ramp 50 and hammer clearance 52 so as to maintain the proper relation to firing controls. In a preferred embodiment, the relational distance between the hammer ramp 50 and the hammer clearance 52 remains the same as in standard AR platform bolt carrier 204, and are moved back a length in the range of about 0.9-1.5 inches, more preferably 0.95-1.3 inches from the anterior bolt end 40. In one preferred embodiment, the length and angle of hammer ramp 50 are substantially the same as that for a standard AR-10 bolt carrier, and the position of hammer ramp 50 is modified such that hammer ramp 50 ends 4.855 inches from the posterior end 41 of bolt carrier 104, and begins 4.125 inches from the anterior end 40 of bolt carrier 104. In still another preferred embodiment, lower surface opening 131 in bolt carrier 104 adjacent hammer clearance 52 is located about 2.660 inches from the posterior end 41 of the carrier. In another preferred embodiment, the overall diameter of shaft 44 of bolt carrier 104 is substantially the same as the overall diameter of shaft 244 of previously designed bolt carrier 204.

Referring now to FIGS. 6D and 6E, in another embodiment, bolt carrier 304 of the present disclosure comprises upper relief cut 354 and lower relief cut 355 to reduce the overall mass of bolt carrier 304, thereby accommodating longer barrel lengths, lower gas pressures and varying cartridge loads, including lower cartridge loads. In a preferred embodiment, the relief cuts are made to shaft 344, particularly to the upper portion, with upper relief cut 354, and the lower portion, with lower relief cut 355, of the shaft 344. In still another embodiment, the upper relief cut 354 begins in the range of about 3.25-4.50 inches, more preferably 4.30 inches, from the bolt carrier anterior end 340 and extends for a distance in the range of about 3.250-4.400 inches, more preferably 4.300 inches. In another preferred embodiment upper relief cut 354 has a depth in the range of about 0.200-0.300 inches, more preferably 0.250 inches. In still another preferred embodiment, lower relief cut 355 begins in the range of about 4.000-4.500 inches, more preferably 4.060 inches from the bolt carrier anterior end 40 and extends for a distance of about 2.400-4.600 inches, more preferably 4.550 inches. In another preferred embodiment, the lower relief cut 355 has a depth in the range of about 0.150-0.300 inches, more preferably 0.204 inches.

Bolt carrier 304 and relief cuts 354 and 355 disclosed herein provide maximum flexibility for ensuring proper engagement of bolt 105 in barrel extension 115 of the rifle disclosed herein under varying cartridge barrel chamber gas pressures, particularly gas pressure variations corresponding to variations in barrel lengths and/or cartridge loads. As will be appreciated by those of ordinary skill in the art, shorter barrel lengths, particularly barrel lengths in the range of about 16-20 inches result in higher cartridge barrel chamber gas pressures, and longer barrel lengths, particularly barrel lengths in the range of about 20-24 inches, produce lower cartridge barrel chamber gas pressures.

Higher gas pressures accommodate greater mass of bolt carrier 104 and stiffer spring tension in buffer spring 111 without compromising full engagement of bolt 105 in barrel extension 115. (see FIG. 2). Where gas pressures are lower, for example with longer barrel lengths, reducing the mass of bolt carrier 104 with one or more relief cuts, such as in the alternate embodiment bolt carrier 304, allows for full and functional engagement of bolt 105 in barrel extension 115. As also will be appreciated by those of ordinary skill in the art, the relief cut bolt carrier 304 disclosed herein accommodates short and long barrel lengths, including barrels lengths in the range of about 16-24 inches; buffer spring 111 has tension in the range of about 15-18 lbs of load per inch of deflection, more preferably in the range of about 17.5 lbs of load; gas pressures in the range of about 16,000-48,000 psi, more preferably in the range of about 26,000 psi, and bolt carrier 104 has a mass in the range of about 0.700-1.1 lbs, more preferably in the range of about 0.79 lbs. It also will be understood by those of ordinary skill in the art that a range of materials are useful in the fabrication of the bolt carrier of the present disclosure, including, without limitation, stainless steel, carbon steel, particularly 86/20 carbon steel, and titanium.

Figure 7A:
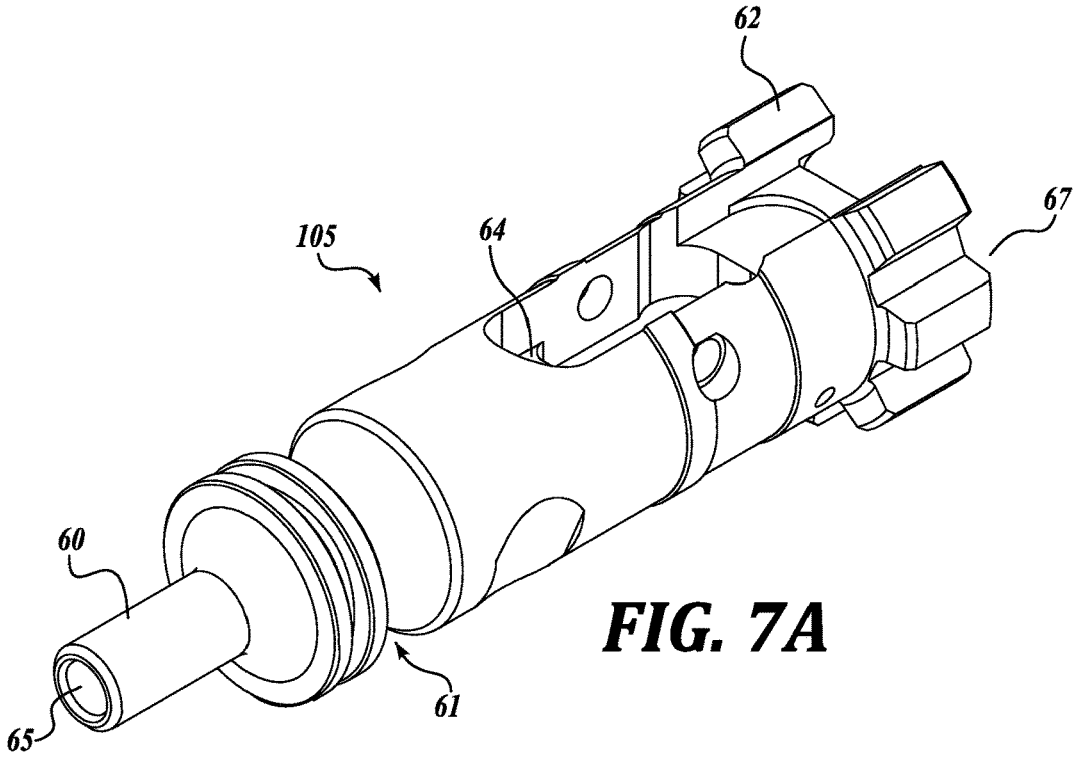
FIG. 7A is an isometric view of the bolt of the firearm of FIG. 1.
Figure 7B:
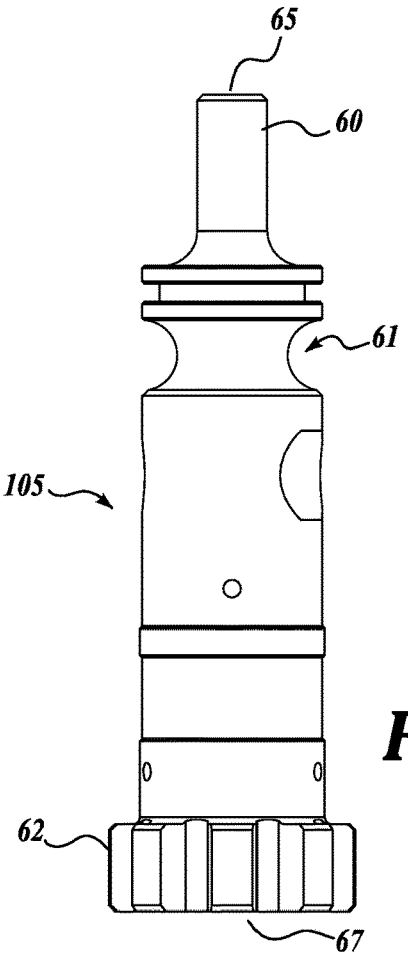
FIG. 7B is a top view of the bolt of the firearm of FIG. 1.
Figure 7C:
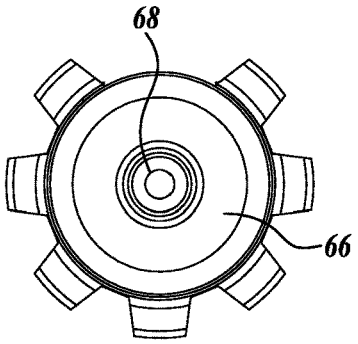
FIG. 7C is a rear view of the bolt of the firearm of FIG. 1.

Referring to FIGS. 7A-7C, bolt 105 is provided. Bolt 105 is configured to interface barrel chamber 109 by inserting and extracting belted cartridges 150 received from magazine assembly 130 (see FIG. 2). Bolt 105 is inserted within bolt carrier 104 and locks within barrel extension 115 when in firing position. Like standard bolts of the AR platform, bolt 105 comprises anterior flutes 62 for locking within corresponding keyways in barrel extension 115, an opening 64 for fitting a bolt extractor, a firing pin engaging end 60 at posterior end 65 of the bolt, and a bolt face 66 at the fluted anterior end 67, which defines a central channel 68 through which firing pin 107 penetrates when the rifle is fired. Additionally, bolt 105 includes gas impingement channel 61 to facilitate the automatic action cycling system described in more detail below. The overall length and diameter of bolt 105 disclosed herein is substantially the same for a standard AR-10 bolt. Bolt 105 is modified to accommodate the larger cartridges contemplated for the firing assembly provided herein by increasing the diameter of bolt face 66 such that it has a diameter in the range of about 0.530-0.545, preferably 0.533-0.537 inches.

Figure 8A:
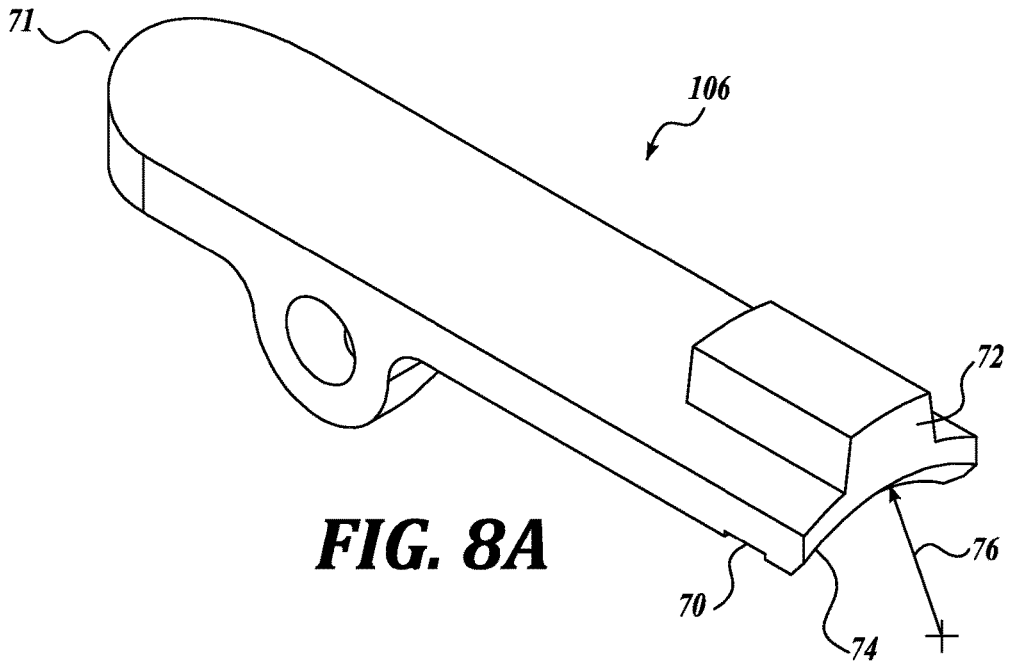
FIG. 8A is an isometric view of the bolt extractor of the firearm of FIG. 1.
Figure 8B:
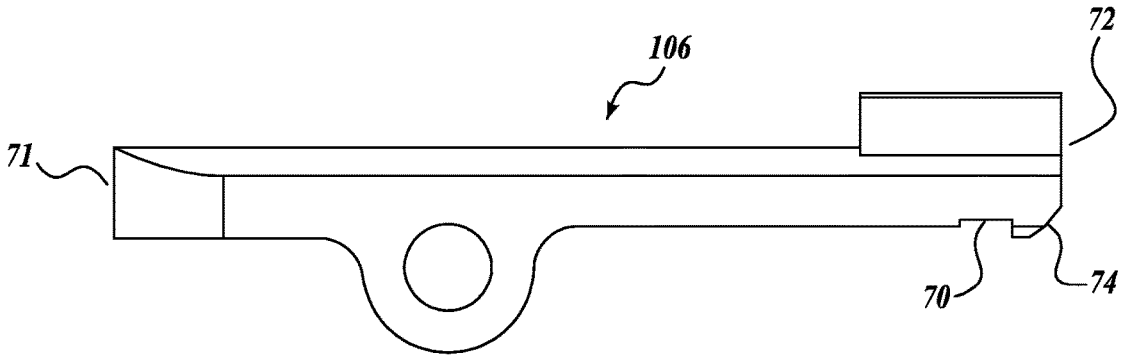
FIG. 8B is a side view of the bolt extractor of the firearm of FIG. 1.

Referring to FIGS. 8A-8B, a bolt extractor 106 is provided. Bolt extractor 106 is configured to attach to bolt 105 to form a bolt assembly and facilitates ejection of the spent cartridge casing (see FIG. 2). Like standard AR platform bolt extractors, bolt extractor 106 comprises an anterior cartridge engagement end 72, and a posterior spring end 70 that seats in opening 64 of bolt 105 (see FIG. 7A). The anterior cartridge engagement end 72 comprises a chamfer 74 on the inferior surface and a groove channel 70 competent to engage a cartridge rim. The overall dimensions and mass of bolt extractor 106 are substantially the same as a bolt extractor of the standard AR platform. Bolt extractor 106 has been modified from the standard AR platform bolt extractor by enlarging groove radius 76 to accommodate and engage the rim of larger caliber cartridges such as the 0.300 Winchester Magnum cartridge. In a preferred embodiment the groove radius 76 is in the range of 0.260-0.281 inches, more preferably it is in the range of about 0.263-0.268 inches.

Referring now to FIG. 9A, a barrel assembly 140 is provided. The barrel assembly 140 is configured to interface with upper receiver 101, bolt 105, and firing pin 107 (see FIG. 2). The barrel assembly 140 includes barrel chamber 109 which houses belted cartridge 150 when in firing position and facilitates the discharge of bullet 152 from barrel 103. The diameter of the wall of barrel 103 typically differs from the diameter of the wall of barrel chamber 109 in that it is typically smaller. In addition, the bore dimensions of barrel chamber 109 vary by cartridge caliber choice. The barrel chamber 109 differs from barrel chambers of the AR platform by having a thinner barrel chamber wall thickness to accommodate a larger diameter belted cartridge 150. In particular, the wall of barrel chamber 109 is reduced by about 0.060-0.063 inches, more preferably by 0.062 inches. Accordingly, preferred barrel chamber walls for use in barrel chamber 109 of this disclosure will have a thickness in the range of about 0.250-0.350 inches, more preferably 0.250-0.275 inches. This range captures the minimum wall thickness achievable for accommodating a larger cartridge without compromising chamber wall integrity which can lead to catastrophic failure. It also captures the maximum wall thickness that can accommodate a larger caliber cartridge without causing jamming or cartridge feed failure.

Barrel assembly 140 also includes components of the direct impingement gas operated firing system configured to automatically cycle the action each time the rifle is fired. The system includes gas port 144 and gas return tube 142 configured to direct expanding gases from firing of the cartridge back to gas impingement channel 61 of bolt 105 (see FIGS. 7A-7C) to facilitate movement through the reloading cycle. As will be appreciated by those of ordinary skill in the art, an indirect gas operated derivative system, such as a short or long stroke piston system, may replace the direct impingement gas operated firing system shown in FIG. 9A, including gas return tube 142. Any other suitable automatic action cycling system is also within the scope of this disclosure.

Like standard AR-10 barrel chambers in the art, barrel assembly 140 further comprises barrel extension 115 operatively associated with barrel 103. Barrel extension 115 is configured to interface bolt 105 during the firing and reloading of the rifle. Barrel extension 115 includes keyways complementary to anterior flutes 62 of fluted anterior end 67 of bolt 105 which locks bolt face 66 against barrel chamber 109 during firing of the rifle. After the rifle is fired, the automatic action cycling system described above facilitates unlocking of the bolt 105 from barrel extension 115 in order to cycle the action and reload the rifle with an unfired cartridge.

Referring now to FIG. 9B, a detailed view of barrel chamber 109 is shown. Together the barrel chamber 109 and barrel 103 have a central bore 98, defining a channel or bore through which a bullet can travel when the rifle is fired. Bullet 152 exits central bore 98 the anterior or bore end of barrel 103. Barrel chamber 109 has been modified from the standard AR platform to include chamfer 92 and recess 96 for seating cartridge belt 94 of belted cartridge 150. Chamfer 92 and recess 96, together known as a counter bore, are dimensioned to allow belted cartridge 150 to seat and establish proper head space 146 rear of belted cartridge 150 from bolt face 66 and firing pin 107. In one preferred embodiment the angle of chamfer 92 has a range of about 20-60 degrees, more preferably 30-45 degrees, and the length of chamfer 92 has a range of about 0.01-0.4 inches. In another preferred embodiment, the depth of the counter bore, measured as the distance between points X and Y in FIG. 9B, has a range of about 0.0905-0.0965 inches. The diameter of recess 96 has a range of about 0.530-0.535 inches.

Figure 10A:
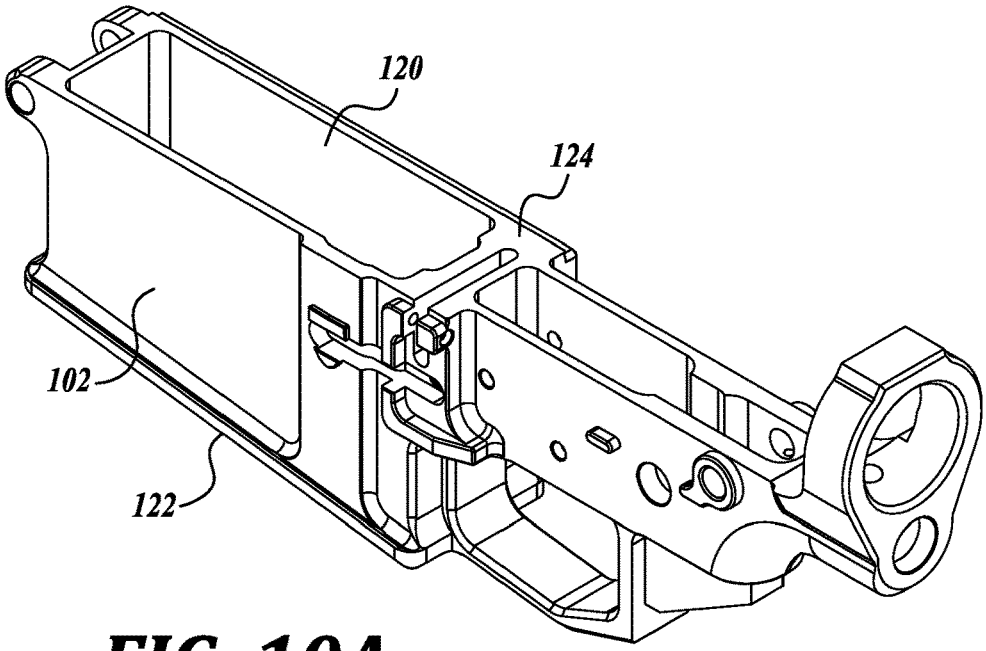
FIG. 10A is an isometric view of the lower receiver of the firearm of FIG. 1.
Figure 10B:
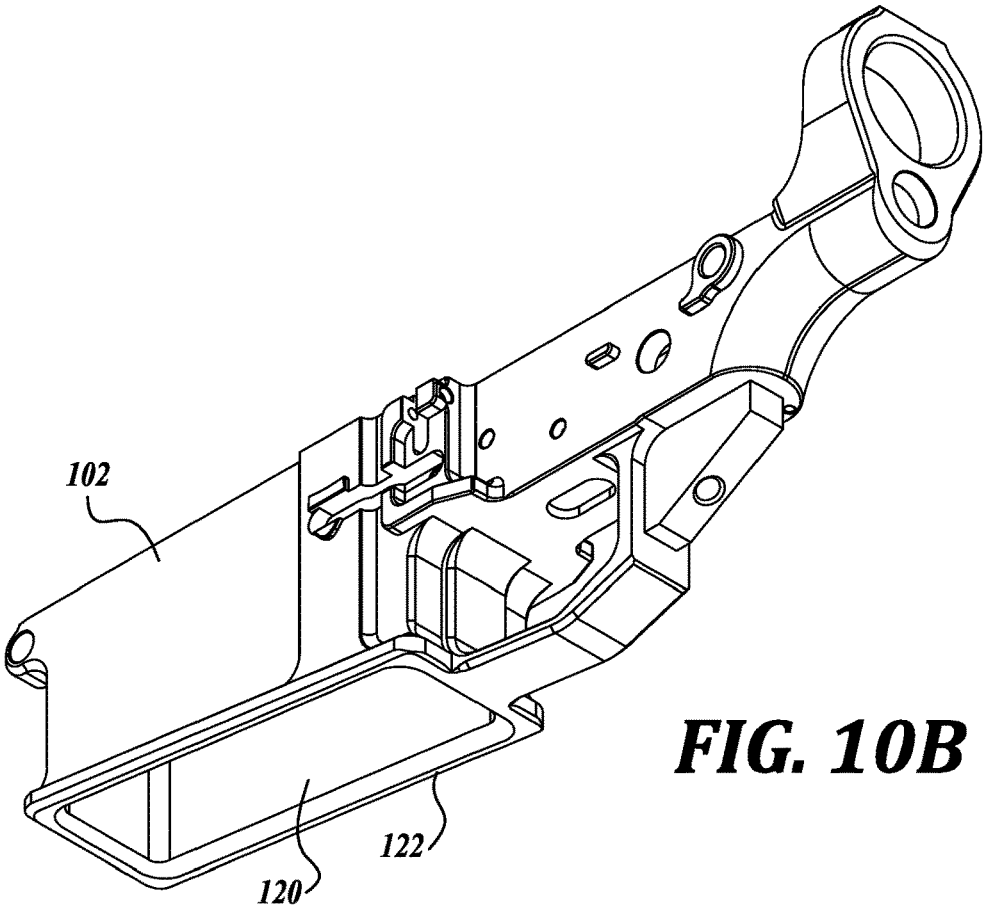
FIG. 10B is a bottom isometric view of the lower receiver of the firearm of FIG. 1.
Figure 10C:
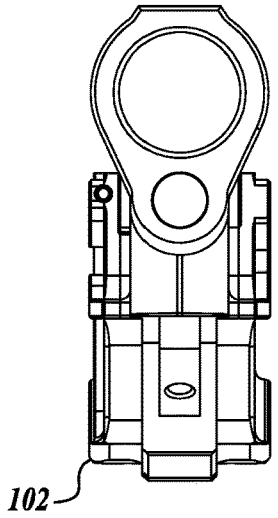
FIG. 10C is a front view of the lower receiver of the firearm of FIG. 1.
Figure 10D:
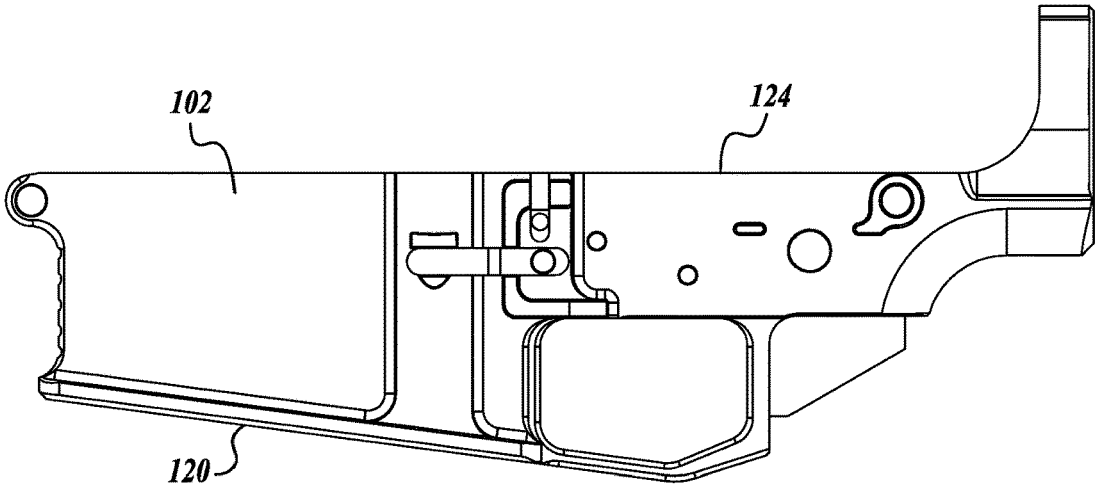
FIG. 10D is a side view of the lower receiver of the firearm of FIG. 1.
Figure 10E:
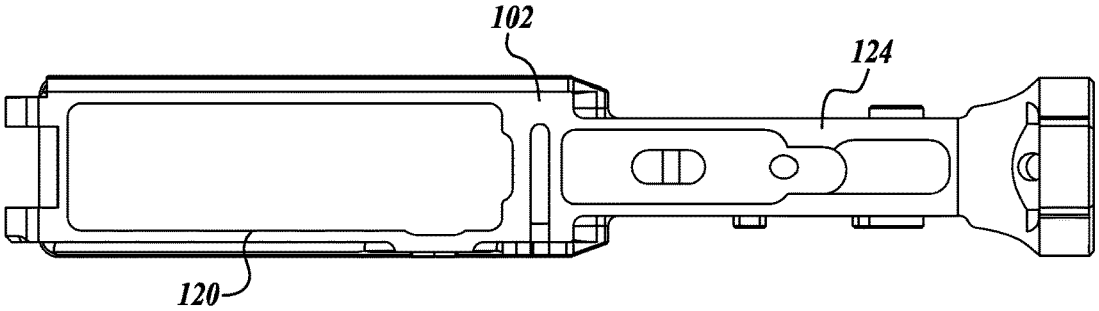
FIG. 10E is a top view of the lower receiver of the firearm of FIG. 1.

Referring to FIGS. 10A-10B, a lower receiver 102 is provided. Like AR platform lower receivers in the art, lower receiver 102 comprises a magazine well 120, but magazine well 120 has been modified to correspond to the dimensional changes to the magazine assembly 130 as described in detail below. Lower receiver 102 differs from standard AR platform lower receivers by having a greater overall length in the range of about 0.90-1.5 inches, more preferably 0.95-1.3 inches. In a preferred embodiment this increased length occurs in the linear wall 122 of the magazine well 120. This modification allows the lower receiver to accommodate a magazine assembly 130 designed to accommodate any of the family of belted cartridges, particularly the larger caliber belted cartridges envisioned for use in firearm 100 of the disclosure presented herein. Examples of larger caliber belted cartridges include, without limitation, the 0.264 Winchester Magnum, 7 mm Winchester Magnum, 0.300 Weatherby Magnum, 0.300 Remington Ultra Magnum, 0.300 Winchester Magnum, 0.338 Winchester Magnum, 0.458 Winchester Magnum, 0.240 Weatherby, 7 mm Remington Mag, 0.300 Ultra Magnum, 0.338 Ultra Magnum, 0.338 Edge, 0.338 Lapua, 0.458 Lott, 0.375 H & H, and the 0.300 H & H.

Figure 4A:
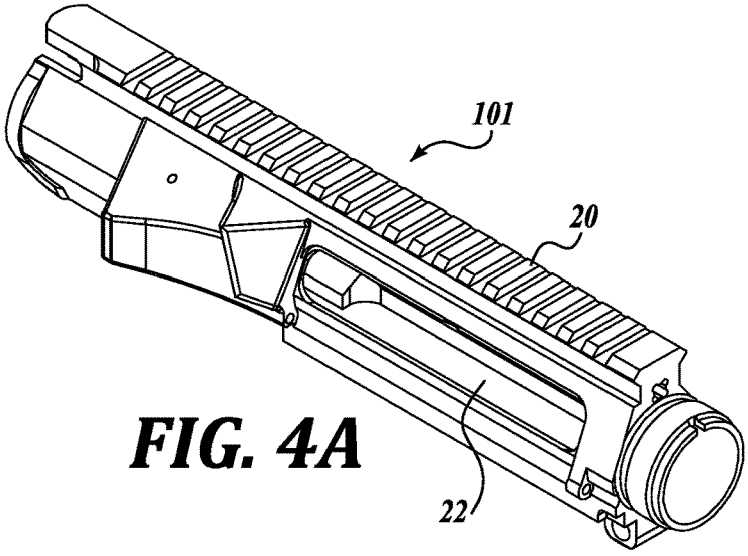
FIG. 4A is an isometric view of the upper receiver of the firearm of FIG. 1.
Figure 4B:
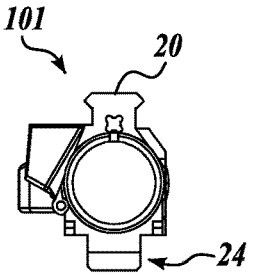
FIG. 4B is a front view of the upper receiver of the firearm of FIG. 1.
Figure 4D:
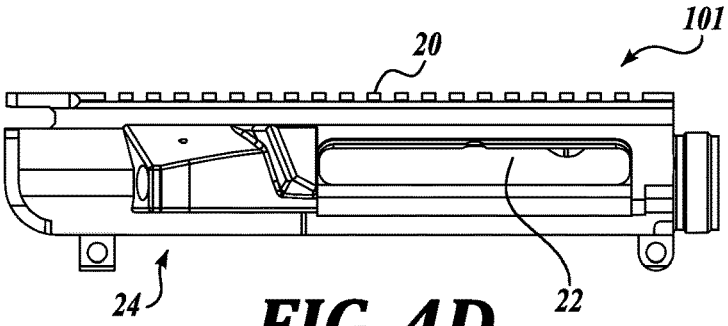
FIG. 4D is a side view of the upper receiver of the firearm of FIG. 1.
Figure 4C:
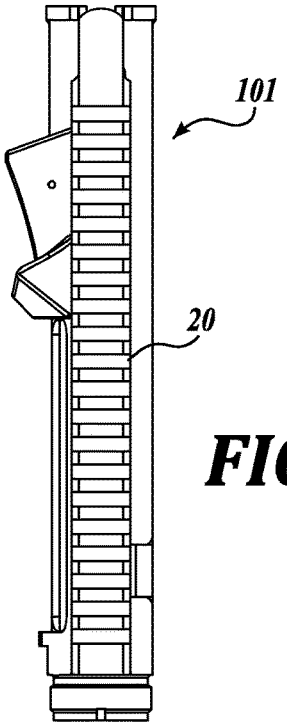
FIG. 4C is a top view of the upper receiver of the firearm of FIG. 1.

The modification in length of linear wall 122 also allows lower receiver 102 to achieve the desired increased length enabling lower receiver mating system 124 to engage properly with upper receiver mating system 24 of upper receiver 101 (see FIGS. 4B and 4D). When assembled, upper receiver 101 and lower receiver 102 co-relate the position of the magazine well 120 with the position of ejection port 22 of upper receiver 101 while not affecting or substantially altering the inter-relationship of the other standard components on an AR platform lower receiver or upper receiver, including, without limitation, the bolt stop, spring and plunger; magazine racks; hammer and trigger and their related pins and springs; and the safety, with its associated detents and springs. Those having ordinary skill in the art will appreciate that a magazine well can be dimensioned to accommodate other preferred magazine assembly features such as cartridge double-loading and desired cartridge capacity.

The AR platform may use either of two butt-stock assemblies: the rifle stock comprising a rifle length buffer and spring, or the carbine stock, comprising a carbine buffer and spring. Proper cycling of the bolt carrier into the receiver extension tube in butt-stock is critical to reliable, safe functioning of the rifle action. In the modified AR firearm 100 disclosed herein, there are two options for achieving this proper cycling with the larger caliber cartridges contemplated. Referring again to FIG. 2, firearm 100 may use a standard rifle butt-stock 110 for use in the AR platform, particularly an AR-10 rifle butt-stock.

Figure 11:
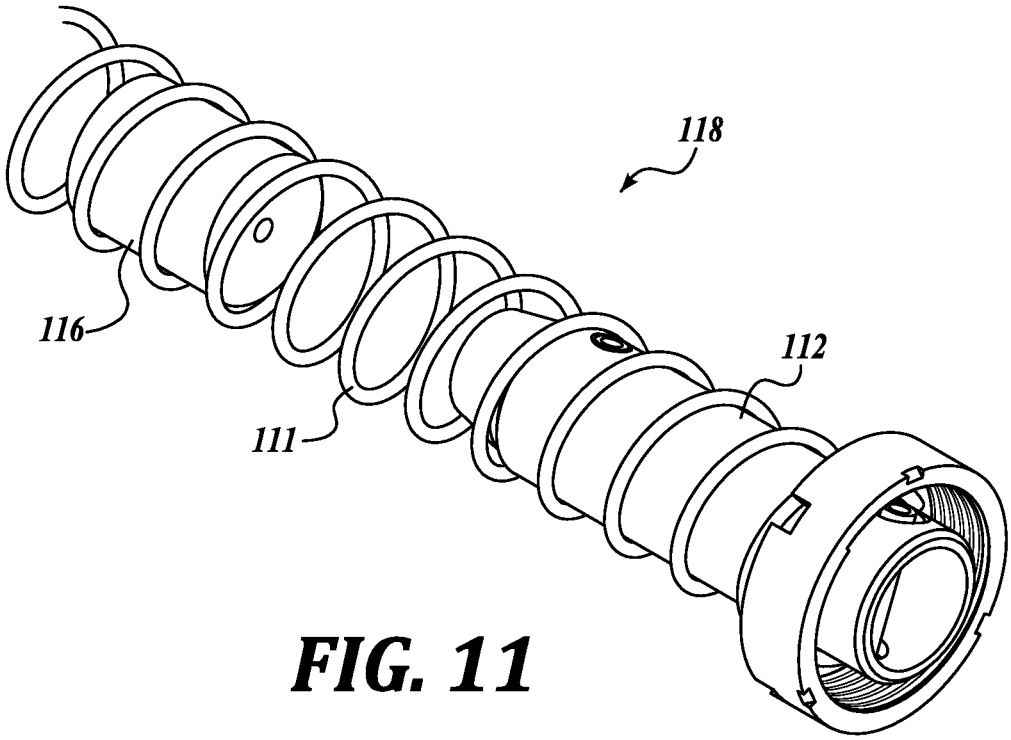
FIG. 11 is an isometric view of the bolt carrier return system of the firearm of FIG. 1.

Referring to FIG. 11, a bolt carrier return system 118 is illustrated. Bolt carrier return system 118 is configured to interface with anterior end 40 of bolt carrier 104 (see FIGS. 6B-6C) and allows the use of a standard rifle butt-stock 110. Bolt carrier return system 118 comprises a carbine buffer 112 and buffer spring 111, rather than a standard rifle buffer. Additionally, a bushing 116 is added to facilitate proper cycling of the bolt carrier 104 through the buffer tube 113 of butt-stock 110. Bushing 116 is a travel limiting device, limiting the rearward travel of the bolt carrier 104 during the cycling of the action, and also acts as a bumper for carbine buffer 112. Alternatively, proper cycling can be achieved by adding an extension to lower receiver 102. In a preferred embodiment, this extension has a linear dimension in the range of 0.45-0.75 inches. In an alternate embodiment, the extension is built into the lower receiver, the added dimension of the extension will be subtracted from the overall longitudinal dimension of the magazine well, so that the overall dimension of a lower receiver of the present disclosure remains in the range of about 0.9-1.5 inches, preferably 0.95-1.3 inches. Where the increase in the length of the lower receiver occurs by means of an extension, together with an increase in the magazine well length, proper cycling of the bolt carrier can be achieved using a carbine butt-stock with a carbine buffer and spring.

Figure 12A:
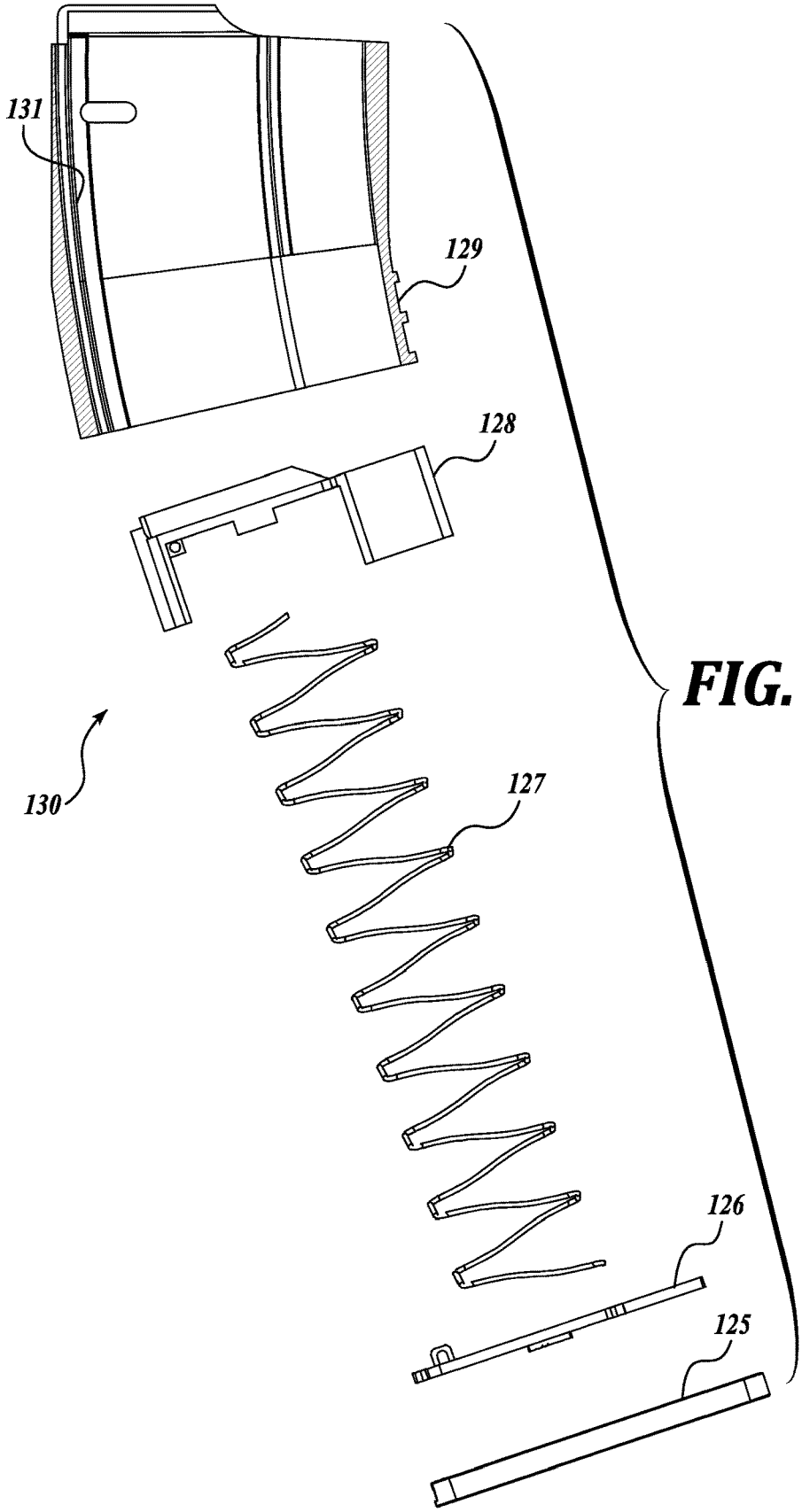
FIG. 12A is a side view of the magazine assembly of the firearm of FIG. 1.
Figure 12B:
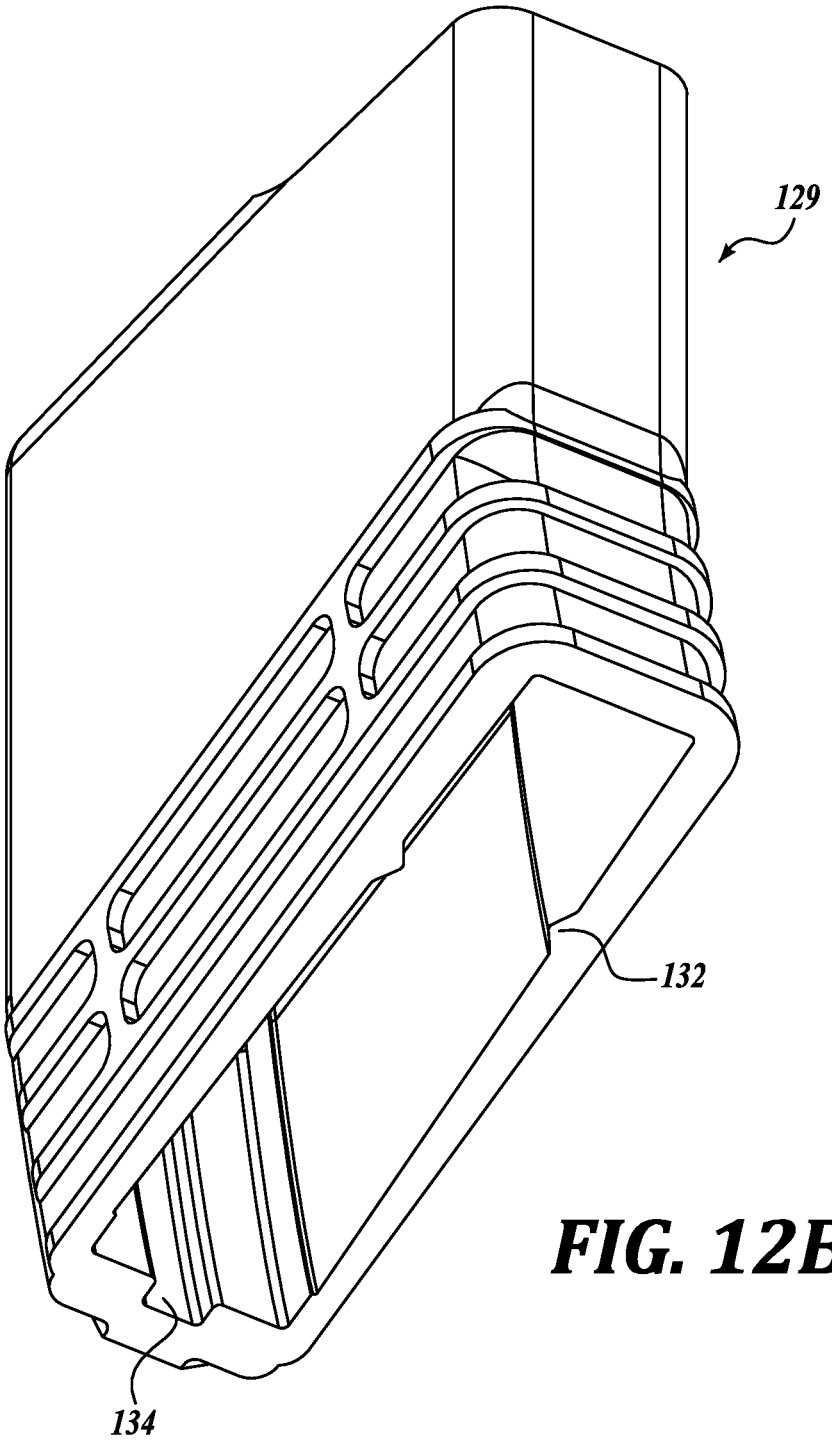
FIG. 12B is a bottom isometric view of the magazine body of the firearm of FIG. 1.

Referring to FIGS. 12A-12B a magazine assembly 130 having utility in the rifle of the present disclosure is illustrated. Magazine assembly 130 is configured to interface with lower receiver 102 and align with ejection port 22 of upper receiver 101 (see FIG. 2). Magazine assembly 130 has a double stack capacity competent to receive belted cartridges and competent to fit and operate in the magazine well 120 of lower receiver 102 disclosed herein. In another embodiment, the double stack capacity magazine disclosed herein is competent to receive belted or non-belted cartridges ranging in length from about 2.800-3.625 inches.

The magazine assembly 130 illustrated in FIGS. 12A-12B comprises a magazine body 129, a follower 128, a magazine spring 127, a spring floor plate 126, and a magazine butt plate 125. Each component is configured to accept larger caliber belted cartridges envisioned for use in firearm 100 of the disclosure presented herein. Useful magazine body 129 external dimensions range in length from about 3.100-4.200 inches, more preferably 4.100 inches, in width from about 1.000-1.500 inches, more preferably 1.125 inches, and in height from about 2.0-8.0 inches, more preferably 5.150 inches. Useful internal dimensions of the magazine body 129 include a length in the range of about 2.800-4.100 inches, more preferably 3.800 inches, a width in the range of about 0.750-1.100 inches, more preferably 0.900 inches, and a height in the range of about 1.900-7.900 inches, more preferably 5.00 inches.

Magazine body 129 preferably has an internal radius 131 that aligns with the radius of stacked belted cartridges. In one embodiment, internal radius 131 is in the range of about 16-20 inches; in another embodiment, the radius is in the range of about 18.6 inches. Those skilled in the art will understand that preferred internal radii will be dictated by caliber choice and the radius produced by a stack of the selected caliber cartridges. As with magazine assemblies of the standard AR platform, magazine body 129 of the present disclosure comprises a channel 134 that runs down the central longitudinal axis on the inner posterior face of magazine body 129, and opposing lips 132 that run longitudinally down the interior lateral sides of magazine body 129. Channel 134 and opposing lips 132 serve to seat and guide the belted cartridges as they are stacked in magazine body 129 and travel up magazine body 129 during operation of the firearm. The dimensions of the channels and lips, as well as their precise locations within the body will vary depending choice of caliber of belted cartridge selected. With the magazine body dimensions disclosed herein, those of ordinary skill in the art will know how to select the desired channel dimensions and lip positioning for a given selected cartridge.

Follower 128 has also been modified from the standard AR platform to conform to the belted cartridges for use in firearm 100 of the disclosure presented herein. Magazine spring 127, spring floor plate 126, and magazine butt plate 125 have been modified from the standard AR platform to correspond to the dimensional changes to the magazine body 129. Components of magazine assembly 130 may be fabricated using materials understood in the art. The magazine assembly of the present disclosure is composed of a non-metal material of sufficient tensile strength to prevent magazine structural deformation during operation while having reduced friction during cartridge delivery as compared with a metal cartridge. In one preferred embodiment the magazine cartridge material comprises glass-filled nylon, comprising 30-50% glass composition.

EXAMPLES

In these illustrative, non-limiting examples, the assembly and use of modified firearm assemblies useful in the AR platform and competent to receive and fire large caliber cartridges, including belted cartridges, are described. The cartridge selected for use in these examples is a 0.300 Winchester Magnum cartridge. As will be understood by those of ordinary skill in the art, the firearm disclosed herein can be constructed to receive other belted cartridges, particularly other large caliber belted cartridges, including, without limitation, the 0.264 Winchester Magnum, 7 mm Winchester Magnum, 0.300 Weatherby Magnum, 0.300 Remington Ultra Magnum, 0.300 Winchester Magnum, 0.338 Winchester Magnum, 0.458 Winchester Magnum, 0.240 Weatherby, 7 mm Remington Mag, 0.300 Ultra Magnum, 0.338 Ultra Magnum, 0.338 Edge, 0.338 Lapua, 0.458 Lott, 0.375 H & H, and the 0.300 H & H.

In the examples that follow, the AR platform firing assemblies and rifles are assembled according to the exploded view depicted in FIG. 2. The Examples list the dimensions of the modified components selected for each rifle. In all cases the butt stock selected was a rifle length butt-stock and the buffer and buffer spring were carbine buffers and springs. Components not listed here were selected as "off the shelf." Following assembly of the AR platform firearms of these examples, the firearms were tested according to the following cycle of operation. In both examples, the range was in excess of 1,000 m, and the pressures tolerated exceeded 65,000 psi.

Firearm Operation: Firing: hammer being released by the trigger seam rotates anteriorly to impact the posterior end of firing pin which travels forward, impacting the primer of the case. Rapid expansion of the burning gases are tapped off the barrel, and guided through the gas tube. The gases impinge on the bolt and carrier causing the bolt carrier to move rearward, unlocking the action. This starts the extraction process removing the fired case from the chamber while simultaneously cocking the hammer. Once the case clears the side of the ejection port, the ejector kicks the spent case from the upper receiver. While the carrier is moving rearward, it impinges on the buffer, compressing the buffer spring. Upon reaching its most rearward point, the carrier is returned anteriorly by the stored energy in the buffer spring. As the carrier continues forward, the next round is fed from the magazine and started into the chamber. At the forwardmost movement of the carrier, the bolt cam pin is pivoted in the cam pin slot, allowing the bolt to rotate, locking the bolt and barrel extension; readying the firearm for the next shot.

Example 1

UPPER RECEIVER, overall dimension: 10.700 inches, MOUNTING RAIL: 9.545 inches; BOLT CARRIER: 8.970 inches; FIRING PIN: overall length: 5.050 inches; FIRING PIN SPRING: overall length: 0.495 inches; overall diameter: 0.034 inches; spring wire diameter: 0.034 inches; CHARGING HANDLE: overall length: 9.175 inches; BOLT EXTRACTOR: extractor groove: 0.276 radius inches; EJECTION PORT: length: 4.45 inches; BOLT FACE: 0.535 inches; CHAMBER WALL THICKNESS: 0.250 inches, minimum; MAGAZINE WELL (LOWER RECEIVER): length: 4.45 inches; width: 0.36; MAGAZINE: body, outer dimensions: length: 4.1 inches; width: 1.25 inches; height: 5.15 inches; inner dimensions: length: 3.8 inches; width: 0.9 inches; height: 5.0 inches; inner radius: 18.6 inches.

Example 2

UPPER RECEIVER, overall dimension: 10.700 inches, MOUNTING RAIL: 9.56 inches; BOLT CARRIER: 8.975 inches; FIRING PIN: overall length: 5.010 inches; FIRING PIN SPRING: overall length: 0.495 inches; overall diameter: 0.034 inches; spring wire diameter: 0.034 inches; CHARGING HANDLE: overall length: 9.00 inches; BOLT EXTRACTOR: extractor groove: 0.281 radius inches; EJECTION PORT: length: 4.40 inches, height: 0.686 inches; BOLT FACE: 0.532 inches; CHAMBER WALL THICKNESS: 0.284 inches; COUNTER BORE "Seat": 0.0905-0.0965 inches. MAGAZINE WELL (LOWER RECEIVER): length: 3.95 inches; width: 1.050 inches; MAGAZINE: body, outer dimensions: length: 4.1 inches; width: 1.25 inches; height: 5.15 inches; inner dimensions: length: 3.8 inches; width: 0.9 inches; height: 5.0 inches; inner radius: 18.6 inches.

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the invention in which an exclusive property or privilege is claimed are defined as follows:

1. An automatic or semi-automatic firearm assembly configured for firing a belted cartridge, the firearm assembly comprising:

a gas operating system for automatic action cycling;

an upper receiver assembly configured for receiving magazine-fed belted cartridges and for ejecting spent cartridge casings through an ejection port;

an elongate firing pin defining a central axis;

an elongate bolt carrier having a central bore, a posterior end configured to interface the firing pin, and an anterior end configured to interface a bolt assembly partially disposed within the central bore, the bolt assembly operative with the firing pin and including a bolt and a bolt extractor;

a bushing configured to interface the bolt carrier and limit travel rearward of the bolt carrier during automatic action cycling;

a charging handle inserted into a distal end of the upper receiver assembly above the central axis, the charging handle slidable parallel to the central axis into the upper receiver assembly; and a barrel chamber having anterior and posterior ends for receiving the belted cartridge, the barrel chamber having a wall thickness between about 0.250 to 0.350 inches, wherein the barrel chamber includes a counter bore at its posterior end to interface the belted portion of the belted cartridge, and wherein the charging handle is configured to engage the bolt assembly for manual action cycling to position an initial belted cartridge within the barrel chamber.

2. The firearm assembly of claim 1, wherein the bolt assembly is partially disposed within the bolt carrier for automatic action cycling.

3. The firearm assembly of claim 1, wherein the gas operating system is sized and configured for a belted cartridge.

4. The firearm assembly of claim 1, configured to tolerate pressures in the range of at least 60,000 psi during operation.

5. The firearm assembly of claim 1, further comprising a lower assembly configured for engaging the upper receiver assembly, the lower assembly having an overall increased length in the range of about 0.90 inches to 1.5 inches when compared to the overall length of a lower assembly in an AR-10 firearm.

6. The firearm assembly of claim 1, wherein the bolt extractor includes a groove having a radius in the range of about 0.260 inches to 0.270 inches.

7. The firearm assembly of claim 1, wherein the bolt has a bolt face having a diameter in the range of 0.530 inches to 0.540 inches.

8. The firearm assembly of claim 1, wherein the firing pin has an overall increased length in the range of about 1.5 inches to 1.85 inches when compared with the shaft of an AR-10 firing pin.

9. The firearm assembly of claim 1, wherein the counter bore has a chamber depth in the range of 0.0905 inches to 0.0965 inches.

10. The firearm assembly of claim 1, wherein the counter bore has a diameter in the range of 0.530 inches to 0.535 inches.

11. The firearm assembly of claim 2, wherein the bolt carrier has an overall increased length in the range of 0.9 inches to 1.5 inches when compared with an AR-10 bolt carrier.

12. The firearm assembly of claim 1, further comprising a magazine having a magazine body defining an inner chamber for receiving stacked belted cartridges, the inner chamber having an internal radius in the range of about 16 inches to about 20 inches.

13. The firearm assembly of claim 1, further comprising a detachable lower assembly configured for engaging the upper receiver assembly, the lower assembly configured to have a magazine attached thereto for supplying ammunition from the magazine to the upper receiver assembly.

14. The firearm assembly of claim 2, wherein the lower relief cut aperture is a hammer clearance opening.

15. The firearm assembly of claim 1, wherein the distance from the posterior end is in the range of about 0.20 inches to 3.0 inches.

16. The firearm assembly of claim 1, wherein the distance from the posterior end is about 0.30 inches.

17. The firearm assembly of claim 1, wherein the bolt carrier further comprises:

an upper relief cut aperture through an outer surface of the bolt carrier, the upper relief cut aperture extending along the elongate bolt carrier from a first position intermediate along a length of the bolt carrier, to a second position located at a distance from the posterior end; and a lower relief cut aperture through the outer surface of the bolt carrier, the lower relief cut aperture extending along the elongate bolt carrier from a third position nearer the anterior end than the first position, to a fourth position located at the distance from the posterior end, such that the lower relief cut aperture is longer than the upper relief cut aperture.

18. An automatic or semi-automatic firearm assembly configured for firing a belted cartridge, the firearm assembly comprising:

a gas operating system for automatic action cycling;

an upper receiver assembly configured for receiving magazine-fed belted cartridges and for ejecting spent cartridge casings through an ejection port;

an elongate firing pin defining a central axis;

an elongate bolt carrier having a central bore, a posterior end configured to interface the firing pin, and an anterior end configured to interface a bolt assembly partially disposed within the central bore, the bolt assembly operative with the firing pin and including a bolt and a bolt extractor, the bolt carrier further comprising:

an upper relief cut aperture through an outer surface of the bolt carrier, the upper relief cut aperture extending along the elongate bolt carrier from a first position intermediate along a length of the bolt carrier, to a second position located at a distance from the posterior end; and a lower relief cut aperture through the outer surface of the bolt carrier, the lower relief cut aperture extending along the elongate bolt carrier from a third position nearer the anterior end than the first position, to a fourth position located at the distance from the posterior end, such that the lower relief cut aperture is longer than the upper relief cut aperture;

a bushing configured to interface the bolt carrier and limit travel rearward of the bolt carrier during automatic action cycling;

a charging handle inserted into a distal end of the upper receiver assembly above the central axis, the charging handle slidable parallel to the central axis into the upper receiver assembly; and a barrel chamber having anterior and posterior ends for receiving the belted cartridge, the barrel chamber having a wall thickness between about 0.250 to 0.350 inches, wherein the barrel chamber includes a counter bore at its posterior end to interface the belted portion of the belted cartridge, wherein the charging handle is configured to engage the bolt assembly for manual action cycling to position an initial belted cartridge within the barrel chamber, and wherein the overall length of the ejection port is between about 3.4 inches and about 4.5 inches.

19. The firearm assembly of claim 18, wherein the gas operating system is sized and configured for a belted cartridge.

20. The firearm assembly of claim 18, configured to tolerate pressures in the range of at least 60,000 psi during operation.

21. The firearm assembly of claim 18, further comprising a lower assembly configured for engaging the upper receiver assembly, the lower assembly having an overall increased length in the range of about 0.90 inches to 1.5 inches when compared to the overall length of a lower assembly in an AR-10 firearm.

22. The firearm assembly of claim 18, wherein the bolt extractor includes a groove having a radius in the range of about 0.260 inches to 0.270 inches.

23. The firearm assembly of claim 18, wherein the bolt has a bolt face having a diameter in the range of 0.530 inches to 0.540 inches.

24. The firearm assembly of claim 18, wherein the firing pin has an overall increased length in the range of about 1.5 inches to 1.85 inches when compared with the shaft of an AR-10 firing pin.

25. The firearm assembly of claim 18, wherein the counter bore has a chamber depth in the range of 0.0905 inches to 0.0965 inches.

26. The firearm assembly of claim 18, wherein the counter bore has a diameter in the range of 0.530 inches to 0.535 inches.

27. The firearm assembly of claim 18, further comprising a magazine having a magazine body defining an inner chamber for receiving stacked belted cartridges, the inner chamber having an internal radius in the range of about 16 inches to about 20 inches.

28. The firearm assembly of claim 18, further comprising a detachable lower assembly configured for engaging the upper receiver assembly, the lower assembly configured to have a magazine attached thereto for supplying ammunition from the magazine to the upper receiver assembly.

29. The firearm assembly of claim 18, wherein the lower relief cut aperture is a hammer clearance opening.

30. The firearm assembly of claim 29, wherein the bolt carrier has an overall increased length in the range of 0.9 inches to 1.5 inches when compared with an AR-10 bolt carrier.

31. The firearm assembly of claim 18, wherein the distance from the posterior end is in the range of about 0.20 inches to 3.0 inches.

32. The firearm assembly of claim 18, wherein the distance from the posterior end is about 0.30 inches.

* * * * *